United States Patent [19]

Furuya et al.

[11] Patent Number: 5,049,473

[45] Date of Patent: Sep. 17, 1991

[54] METHOD OF PRESERVING COLORED IMAGES

[75] Inventors: Kazuhiko Furuya; Satoru Sawada, both of Kanagawa, Japan

[73] Assignee: Fuji Photo Film Co., Ltd., Kanagawa, Japan

[21] Appl. No.: 325,339

[22] Filed: Mar. 17, 1989

[30] Foreign Application Priority Data

Mar. 17, 1988 [JP] Japan ..... 63-64118

[51] Int. Cl.[5] ..... G03C 5/54

[52] U.S. Cl. ..... 430/203; 430/216; 430/551

[58] Field of Search ..... 430/203, 216, 551

[56] References Cited

U.S. PATENT DOCUMENTS

| | | | |
|---|---|---|---|
| 3,700,455 | 10/1972 | Ishikawa et al. | 430/551 |
| 4,360,589 | 11/1982 | Kojima et al. | 430/551 |
| 4,741,980 | 5/1988 | Kaneko | 430/216 |
| 4,818,662 | 4/1989 | Aono et al. | 430/203 |
| 4,840,870 | 6/1989 | Iwagaki et al. | 430/203 |
| 4,847,188 | 7/1989 | Komamura et al. | 430/203 |

FOREIGN PATENT DOCUMENTS 20256537 2/1988 European Pat. Off. .

OTHER PUBLICATIONS

Van Maele et al., *Research Disclosure* No. 26373, 3/1986, pp. 166, 168 & 169 (167 missing).

Chemical Abstracts, vol. 109, 1988, p. 92, No. 75173m.

*Primary Examiner*—Richard L. Schilling

*Attorney, Agent, or Firm*—Sughrue, Mion, Zinn, Macpeak & Seas

[57] ABSTRACT

A method of preserving colored images formed by exposing imagewise a heat developable color photosensitive element which has a construction which includes, on a support, at least a photosensitive silver halide, a binder and a dye providing substance which forms or releases a diffusible dye in proportion, or in inverse proportion, to a reaction in which the silver halide is reduced to silver; thereafter or simultaneously heating said element to form a diffusible dye; and transferring the diffusible dye image to a dye fixing element, wherein the photosensitive element or the dye fixing element further comprises at least one of a compound of which the quenching rate constant for the excited triplet of arylazonaphthol yes is at least $1\times10^5\ M^{-1}\cdot sec^{-1}$ and a compound of which the quenching rate constant for singlet state oxygen is at least $1\times10^7\ M^{-1}\cdot sec^{-1}$.

2 Claims, No Drawings

METHOD OF PRESERVING COLORED IMAGES

FIELD OF THE INVENTION

This invention concerns a method of preserving colored images formed by heat development.

BACKGROUND OF THE INVENTION

Photographic methods in which silver halides are used have been widely used in the past since they provide better photographic characteristics, such as photographic speed and gradation control, than do other photographic methods such as electrophotography or diazo photography. Color diffusion transfer processes in which a photosensitive element which has a silver halide emulsion layer and an image receiving element which has an image receiving layer are superimposed on one another and an alkaline processing composition is spread in the form of a layer inside the combination, or the combination is immersed in an alkali processing bath, are included among photographic methods in which silver halides are used. In recent years, techniques from which images can be obtained easily and quickly by the application of a dry process with heating, for example, have been developed apart from the wet methods using conventional development baths for the formation of an image with photosensitive materials in which silver halides are used.

Methods of image formation with thermal development have been disclosed, for example, in JP-A-57-179840, JP-A-57-186774, JP-A-57-198458, JP-A-57-207250, JP-A-58-58543, JP-A-58-79247, JP-A-58-116537, JP-A-58-149046, JP-A-59-48764, JP-A-59-65839, JP-A-59-71046, JP-A-59-87450, JP-A-59-88730, JP-A-62-253159 and European Patent 220,746A2. (The term "JP-A" as used herein means an "unexamined published Japanese patent application".)

These are methods in which mobile dyes are formed or released in proportion, or in inverse proportion, to the reaction when a photosensitive silver halide and/or organic silver salt is reduced by heat development to silver, and the mobile dye is transferred to a dye fixing element.

The method of forming images by transferring a diffusible dye formed by heat development to an image fixing element has a major advantage in that the dye image can be obtained easily and quickly. However, when the image obtained is stored for a prolonged period of time, the colors are liable to fade or change for reasons different from those seen in color images formed by the ordinary wet processing. This is because heat is applied during the image formation or transfer and, therefore, the dyes cause denaturation by themselves, or substances which impart adverse influences with respect to color fading or change are formed and transferred to the dye fixing element together with the dyes.

SUMMARY OF THE INVENTION

Hence, an object of this invention is to provide a method of preserving colored images produced by transferring a diffusible dye formed by heat development to a dye fixing element, with improved storage properties over prolonged periods of time.

The present invention has been made based on the finding that in order to improve the storage properties of color images produced by transferring a diffusible dye formed by heat development to a dye fixing element, a compound having specified physical properties is effective.

This object of the invention has been realized by providing a method of preserving colored images formed by exposing imagewise a heat developable color photosensitive element which has a construction which includes, on a support, at least a photosensitive silver halide, a binder and a dye providing substance which forms or releases a diffusible dye in proportion, or in inverse proportion, to a reaction in which the silver halide is reduced to silver; thereafter or simultaneously heating said element to form a diffusible dye; and transferring the diffusible dye image to a dye fixing element, wherein the photosensitive element or the dye fixing element further comprises at least one of a compound of which the quenching rate constant for the excited triplet of arylazonaphthol dyes is at least $1\times10^5$ $M^{-1}\cdot sec^{-1}$ and/or a compound of which the quenching rate constant for singlet state oxygen is at least $1\times10^7$ $M^{-1}\cdot sec^{-1}$.

It has been found that in order to improve the storage properties of color images produced by transferring a diffusible dye formed by heat development to a dye fixing element, the use of at least one of a compound of which the quenching rate constant (referred to below as $k_q\cdot T_1$) for the excited triplet of arylazonaphthol dyes ($T_1$) is at least $1\times10^5 M^{-1}\cdot sec^{-1}$, and preferably at least $5\times10^5$ $M^{-1}\cdot sec^{-1}$, and/or a compound of which the quenching rate constant for singlet oxygen is at least $1\times10^7$ $M^{-1}\cdot sec^{-1}$, and preferably at least $1\times10^8$ $M^{-1}\cdot sec^{-1}$, is very effective for this purpose.

The object of this invention can be realized by including these compounds in the colored image, and the compounds of the invention may be previously added to the dye fixing element. Further, they may be tansferred from the heat developable color photosensitive element to the dye fixing element together with the dye. In either case, the compounds of the invention may be present in any of the layers on the side on which the colored image is finally included on a support. The best effect is achieved when the compounds are added to the dye fixing layer of the dye fixing element or to a layer adjacent thereto.

The amount of the compound of this invention used differs according to the type of compound, but the compounds are preferably used in a mol to mol ratio with respect to the dye providing compound within the range from 0.01 to 1, and more preferably within the range from 0.1 to 5.

In the present invention, the arylazonaphthol dye means a dye having the following structure:

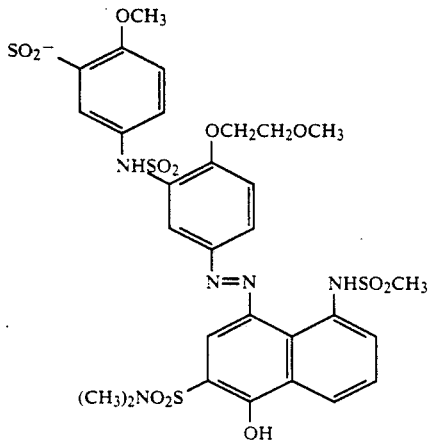

DETAILED DESCRIPTION OF THE INVENTION

The compounds of the invention are described in detail below.

In this invention, the compounds of which the quenching rate constant ($k_q \cdot T_1$) for triplet arylazonaphthol dyes in at least $1 \times 10^5$ $M^{-1} \cdot sec^{-1}$ can be determined using a test method such as that described below.

First, a method in which a sample solution contained in a quartz cell is flashed using a pulse laser or a flash tube as the exciting light source is generally used for generating photo-excited triplet states. The ultraviolet and visible absorption spectra of molecules which have been excited in this way are monitored using a photomultiplier tube to observe the decay in the absorption at the wavelength of the absorption of the triplet state of the dye using a xenon lamp as a monitoring light source. The decay curve is represented as a single log plot and the life of the excited triplet can be obtained from the absolute value of the slope of the linear plot.

Flash photolysis apparatus with a flash lamp (FXQ33-2) made by the EG and G Company as the exciting light source and a 150 W xenon lamp for the monitoring light was used in these tests.

The arylazonaphthol dye is dissolved to provide a 20 μM solution in a mixed solvent consisting of tetrahydrofuran and water (this may be varied within the range from 1/1 to 3/1 by volume) and the life ($\tau_0$) of the excited triplet with the dye alone is obtained without a degassing treatment. Next, the compound which is to be tested is added in varying concentrations; the life ($\tau i$, $\tau j$, . . . ) of the triplet is obtained in the same way as before, a Stern-Volmer plot is made and the gradient of this plot is obtained. The gradient is equivalent to $k_q \cdot T_1 \cdot \tau_0$ and so the quenching rate constant ($K_q \cdot T_1$, units $M^{-1} \cdot sec^{-1}$) can be obtained by dividing by $\tau_0$.

This method for measuring quenching rate constants of excited triplet is based on the methods described in the literature, for example by G. Porter and M. W. Windsor in *J. Chem. Phys.*, 1953, 2088 (1954), by N. Yamamoto, Y. Nakao and H. Tsubomura in *Bull. Chem. Soc. Jpn.*, 39, 2603 (1966) and by Kira and Nishi in *Rikagaku Kenkyujo Hokoku*, 44, 56 (1968).

Alternatively, compounds of which the quenching rate constant ($K_q \cdot O_2$) for singlet oxygen is at least $1 \times 10^7$ $M^{-1} \cdot sec^{-1}$ can be determined using the following test method.

A method in which a rubrene (a representative structure of which appears below) α autosensitizing singlet oxidation reaction is used has already been reported for measuring quenching rate constants ($K_q \cdot O_2$) for singlet oxygen ($^1O_2$).

rubrene

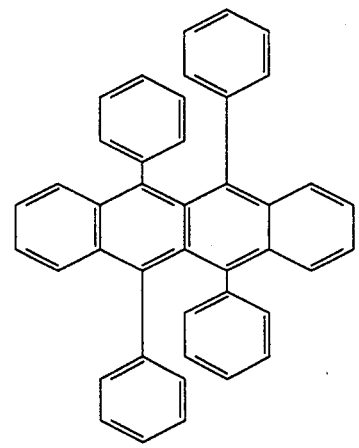

If rubrene is represented by R and oxygen is represented by $O_2$, this method can be represented by the following equations.

$$\left.\begin{array}{l} R + h\nu \rightarrow {}^1R^* \\ {}^1R^* + O_2 \rightarrow {}^3R^* + {}^1O_2^* \\ {}^3R^* + O_2 \rightarrow R + {}^1O_2^* \end{array}\right\} \text{The rate of formation of } {}^1O_2^* \text{ is } R_i.$$

$$^1O_2^* \xrightarrow{k_d} O_2$$

$$R + {}^1O_2^* \xrightarrow{k_{OX}} RO_2$$

$$Q + {}^1O_2^* \xrightarrow{k_q \cdot O_2} Q^* + O_2 \text{ (and/or } QO_2) - \frac{d[R]}{dt} = k_{OX}[R][{}^1O_2^*]$$

$$\frac{d[{}^1O_2^*]}{dt} = R_i - k_{OX}[R][{}^1O_2^*] - k_q \cdot O_2[Q][{}^1O_2^*] - k_d[{}^1O_2^*]$$

If a steady state is assumed for $[{}^1O_2^*]$, then:

$$[O_2] = \frac{R_i}{k_{OX}[R] + k_d + k_q \cdot O_2[Q]}$$

Hence, $$-\frac{d[R]}{dt} = \frac{k_{OX}[R] \cdot R_i}{k_{OX}[R] - k_d + k_q \cdot O_2[Q]}$$

$$\int_O^F \frac{k_{ox}[R] + (k_d + k_q \cdot O_2[QJ])}{k_{ox}[R]} d[R] = -R_i \cdot dt$$

$$\int_O^F \left[1 + \left(\frac{k_d + k_q \cdot O_2[Q])}{k_{ox}}\right) \cdot \frac{1}{R}\right] dR = -R_{it} - \text{const}$$

$$[R] + \frac{k_d + k_q \cdot O_2[Q])}{k_{ox}} \ln[R] = -R_{it} - \text{const}$$

When t=0, $[R]=[R_0]$ and so:

$$\text{const} = [R_0] + \frac{k_d + k_q \cdot O_2[Q]}{k_{ox}} \ln[R_0]$$

Therefore:

$$R_{it} = [R_0] + \frac{k_d + k_q \cdot O_2[Q]}{k_{OX}} \ln[R_0] - [R] - \frac{k_d + k_q \cdot O_2[Q]}{k_{OX}} \ln[R] = \frac{k_d + k_q \cdot O_2[Q]}{k_{OX}} \cdot \ln \frac{[R_0]}{[R]} + [R_0]_0^Q - [R]^Q_{F(inal)}$$

In the absence of a compound being tested, [Q]=0:

$$R_{ft} + \frac{k_d}{k_{OX}} \ln \frac{[R_0]}{[R]} + [R_0]_0^0 - [R]_F^0$$

The same concentration of rubrene is used in systems which do and do not contain a compound for testing and the same amount of light is directed onto the same volume of solution.

$$T_{it} = R_{ft}$$

$$[R]_0^Q = [R]_0^0 = [R]$$

$$k_q \cdot O_2 = \frac{k_{OX}([R]_F^Q - [R]_F^0) + k_d \ln([R]_F^Q/[R]_F^Q)}{[Q]\ln([R]/[R]_F^0)}$$

In chloroform solution:

$$K_{OX} = 5.3 \times 10^7,\ kd = 1.7 \times 10^4$$

Hence, in the tests, [R] is set equal to $5 \times 10^{-4}$M, and Q is set equal to $10^{-3}$M and the samples are irradiated with visible light only using a sharp cut filter SC-42, made by the Fuji Photo Film Co., Ltd.

This method of measuring the quenching rate constant for singlet oxygen is based on methods described by D. J. Carlsson et at., *Can. J. Chem.*, 52, 3728 (1974), B. M. Monroe et al., *J. Phys. Chem.*, 83, 591 (1979), and B. M. Monroe, *J. Phys. Chem.*, 81, 1861 (1977).

Compounds suitable for use are selected from among those compounds which can be represented by the general formuale [I] to [V] indicated below.

General Formula [I]

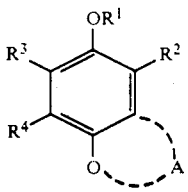

In this formula, $R^1$ represents a hydrogen atom, alkyl group, acyl group, sulfonyl group, carbamoyl group, sulfamoyl group, alkoxycarbonyl group or trialkylsilyl group, and A represents a group of non-metal atoms which, together with $$-\overset{|}{C}=\overset{|}{C}-O-,$$

complete a five or six membered ring. $R^2$, $R^3$ and $R^4$ each represents a hydrogen atom, alkyl group, cycloalkyl group, alkoxy group, aryl group, aryloxy group, aralkyl group, aralkoxy group, alkenyl group, alkenoxy group, acylamino group, halogen atom, alkylthio group, diacylamino group, arylthio group, alkoxycarbonyl group, acyloxy group, acyl group or sulfonamido group, and they may be the same or different.

Moreover, five or six membered bis-spiro compounds containing A are included among the compounds represented by the general formula [I].

General Formula [II]

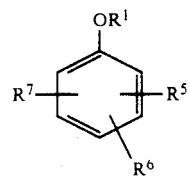

In this formula, $R^1$ is the same as the $R^1$ group defined in connection with general formula [I]. $R^5$ represents an alkyl group, alkoxy group, alkoxycarbonyl group, arylthio group, arylsulfinyl group, arylsulfonyl group, aralkyl group, halogen atom, aryl group or acyl group, and $R^6$ represents a hydrogen atom, alkyl group, alkoxy group (but $R^1O$— and $R^6$ are not the same), aralkyloxy group (but $R^1O$— and $R^6$ are not the same), alkylthio group, aralkylthio group, acylamino group, acyl group, alkylamino group, arylamino group or heterocyclic amino group. $R^7$ represents a hydrogen atom, halogen atom, alkyl group, arylthio group, alkylthio group, arylsulfonyl group, arylsulfinyl group, aralkyl group, aryl group, aryldithio group or an aryloxy group.

General Formula [III]

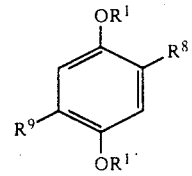

In this formula, $R^8$ represents a hydrogen atom or linear or branched chain alkyl group or alkenyl group; $R^9$ represents a linear or branched chain alkyl group or alkenyl group, and $R^8$ and $R^9$ may be the same or different. Furthermore, $R^1$ has the same meaning as $R^1$ in general formula [I]. Furthermore, substituents $R^8$ and $R^9$ may contain an —NHCO— bond within the group.

General Formula [IV]

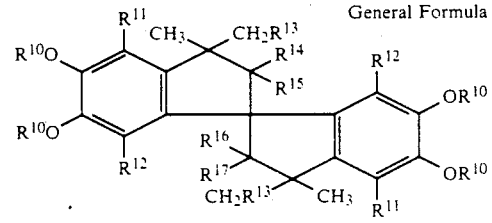

In this formula, $R^{10}$ represents an alkyl group, alkenyl group, aryl group, aralkyl group, heterocyclic group or group which can be represented by $R^{18}CO$, $R^{19}SO_2$ or $R^{20}NHCO$. Here, $R^{18}$, $R^{19}$ and $R^{20}$ each independently represents an alkyl group, alkenyl group, aryl group or heterocyclic group. $R^{11}$ and $R^{12}$ each independently represents a hydrogen atom, halogen atom, alkyl group, alkenyl group, alkoxy group or alkenoxy group, and $R^{13}$, $R^{14}$, $R^{15}$, $R^{16}$ and $R^{17}$ each independently represents a hydrogen atom, alkyl group, alkenyl group or aryl group.

General Formula [V]

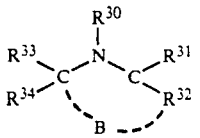

In this formula, B represents a group of non-metal atoms which, together with the adjacent atoms forms a five to seven membered ring. $R^{30}$ represents a hydrogen atom, alkyl group, alkenyl group, alkynyl group, acyl group, sulfonyl group, sulfinyl group, oxy radical group or hydroxyl group, and $R^{31}$, $R^{32}$, $R^{33}$ and $R^{34}$ may be the same or different, each representing a hydrogen atom or alkyl group.

The anti-color fading agents represented by the general formulae [I] to [V] are now described in detail below.

General Formula [I]

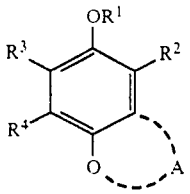

Here, $R^1$ represents a hydrogen atom; an alkyl group which preferably has from 1 to 22 carbon atoms (for example, methyl, ethyl, propyl, n-octyl, dodecyl, hexadecyl); an acyl group (for example, acetyl, benzoyl, pentanoyl, (2,4-di-tert-amylphenoxy)acetyl); a sulfonyl group (for example, methanesulfonyl, butanesulfonyl, benzenesulfonyl, toluenesulfonyl, hexadecanesulfonyl); a carbamoyl group (for example, N-methylcarbamoyl, N,N-diethylcarbamoyl, N-dodecylcarbamoyl, N-phenylcarbamoyl); a sulfamoyl group (for example, N-methylsulfamoyl, N,N-dimethylsulfamoyl, N-tetradecylsulfamoyl, N-phenylsulfamoyl); an alkoxycarbonyl group (for example, methoxycarbonyl, ethoxycarbonyl, benzyloxycarbonyl, phenoxycarbonyl); or a trialkylsilyl group (for example, trimethylsilyl, dimethylbutylsilyl); and A represents a group of non-metal atoms which, together with $$-\overset{|}{C}=\overset{|}{C}-O-,$$

forms a five or six membered ring. This ring may be substituted, and the preferred substituent groups include alkyl groups (for example, methyl, t-butyl, cyclohexyl, octyl, dodecyl, octadecyl); alkoxy groups (for example, methoxy, butoxy, dodecyloxy); aryl groups (for example, phenyl); aryloxy groups (for example, phenoxy); aralkyl groups (for example, benzyl, phenethyl); aralkoxy groups (for example benzyloxy, phenethyloxy); alkenyl groups (for example, allyl); N-substituted amino groups (for example, alkylamino, dialkylamino, N-alkyl-N-arylamino, piperadino) and heterocyclic groups (for example, benzothiazolyl, benzooxazoyl). The above-mentioned alkyl groups and aryl groups may be further substituted, preferably with one or more halogen atoms, hydroxyl groups, carboxyl groups, alkoxycarbonyl groups, acyloxy groups, sulfo groups, sulfonyloxy groups, amido groups (for example, acetamido, ethanesulfonamido, benzamido), alkoxy groups and aryloxy groups.

$R^2$, $R^3$ and $R^4$ each independently represents a hydrogen atom, alkyl group (for example, methyl, t-butyl, cyclopentyl, n-octyl, t-octyl, dodecyl, octadecyl); cycloalkyl group (for example, cyclohexyl); alkoxy group (for example, methoxy, butoxy, dodecyloxy); aryl group (for example, phenyl); aryloxy group (for example phenoxy); aralkyl group (for example, benzyl, phenethyl), aralkoxy group (for example, benzyloxy, phenethyloxy); alkenyl group (for example, allyl); alkenoxy group (for example, allyloxy); acylamino group (for example, acetylamino, benzamido, (2,4-di-tert-amylphenoxy)acetylamino); halogen atom (for example, chlorine, bromine); alkylthio group (for example, ethylthio, dodecylthio, octadecylthio); diacylamino group (for example, succinimido, hydantoinyl); arylthio group (for example, phenylthio); alkoxycarbonyl group (for example, methoxycarbonyl, ethoxycarbonyl, benzyloxycarbonyl); acyloxy group (for example, acetyloxy, benzoyloxy); acyl group (for example, methylcarbonyl); or a sulfonamido group.

Moreover, five and six membered bis-spiro compounds which contain A are included among the compounds represented by general formula [I]. The bis-spiro compounds which are useful in the invention can be represented by the general formula [I'] indicated below.

General Formula [I']

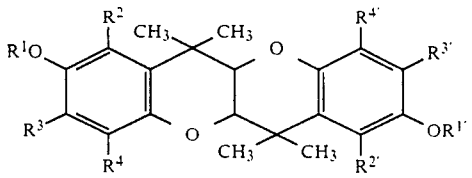

$R^1$, $R^2$, $R^3$, $R^4$, $R^{1'}$, $R^{2'}$, $R^{3'}$ and $R^{4'}$ have the same significance as $R^1$, $R^2$, $R^3$ and $R^4$ in general formula [I].

Those compounds in which the total number of carbon atoms included in $R^2$, $R^3$, $R^2$ and A in the aforementioned general formula [I] is at least 8, and those compounds represented by general formula [I'] have low diffusibility and are suitable for being selectively located in a specified hydrophilic layer of a dye fixing material. Furthermore, 5-hydroxycoumarans and 6-hydroxychromans in which one of $R^2$ and $R^3$ in the aforementioned general formula [I] is a hydrogen atom, and 6,6'-dihydroxybis-2,2'-spirochromans, in which the total number of carbon atoms included in the molecule is preferably up to about 40 are especially useful for purposes of the present invention. Most desirably, $R^2$, $R^3$, $R^4$, $R^{2'}$, $R^{3'}$ and $R^{4'}$ in general formula [I] and general formula [I'] are alkyl groups, alkoxy groups, aryl groups, aryloxy groups or arylthio groups.

General Formula [II]

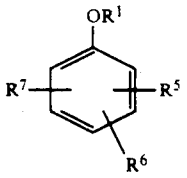

In this formula, $R^1$ is the same as $R^1$ defined in general formula [I]; $R^5$ is preferably a substituted or branched chain alkyl group which has from 1 to 22 carbon atoms (for example, methyl, t-butyl, n-octyl, t-octyl, dodecyl, hexadecyl); an alkoxy group which has from 1 to 22 carbon atoms (for example, methoxy, ethoxy, octyloxy, tetradecyloxy); an alkoxycarbonyl group (for example, ethoxycarbonyl); an arylthio group (for example, phenylthio); an arylsulfinyl group (for example, phenylsulfinyl); an arylsulfonyl group (for example, phenylsulfonyl); an aralkyl group (for example, benzyl, phenethyl); a halogen atom (for example, chlorine, bromine); an aryl group (for example, phenyl, α- or β-naphthyl); or an acyl group (for example, acetyl, butanoyl, benzoyl). $R^6$ preferably represents a hydrogen atom; an alkyl group which has from 1 to 22 carbon atoms (for example, methyl, ethyl, t-butyl, t-octyl, n-dodecyl, n-hexadecyl); an alkoxy group which has from 1 to 22 carbon atoms (for example, methoxy, n-butyloxy, n-octyloxy, n-dodecyloxy, n-tetradecyloxy, 2-ethylhexyloxy; but $R^1O$— and $R^6$ are not the same substituent group); an aralkyloxy group which has from 7 to 22 carbon atoms (for example, benzyloxy β-phenethyloxy; but $R^1O$— and $R^6$ are not the same substituent group); an alkylthio group which has from 1 to 22 carbon atoms (for example, methylthio, octylthio, dodecylthio, hexadecylthio); an aralkylthio group (for example, benzylthio, β-phenethylthio); an acylamino group which has from 2 to 22 carbon atoms (for example, acetylamino, benzamido); an acyl group which has from 2 to 22 carbon atoms (for example acetyl, butanoyl, benzoyl); an alkylamino group which has from 1 to 22 carbon atoms (for example, methylamino, ethylamino, N,N-dimethylamino, N-methyl-N-dodecylamino); an arylamino group which has from 6 to 22 carbon atoms (for example, phenylamino, N-phenyl-N-methylamino, β-naphthylamino); or a heterocyclic amino group (for example, a group which can be represented by the formulae indicated below):

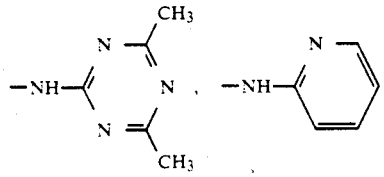

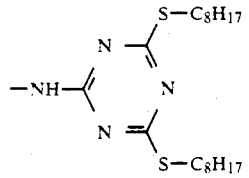

$R^7$ preferably represents a hydrogen atom; a halogen atom (for example, chlorine, bromine); an alkyl group which has from 1 to 22 carbon atoms (for example, methyl, ethyl, t-butyl, t-octyl, t-amyl, t-hexyl, n-hexadecyl); an arylthio group which has from 6 to 22 carbon atoms (for example, phenylthio); an alkylthio group which has from 1 to 22 carbon atoms (for example, methylthio, octylthio, dodecylthio, octadecylthio); an arylsulfonyl group which has 6 to 22 carbon atoms (for example, phenylsulfonyl); an arylsulfinyl group which has from 6 to 22 carbon atoms (for example, phenylsulfinyl); an aralkyl group which has from 7 to 32 carbon atoms (for example, benzyl, α- or β-phenethyl); an aryl group which has from 6 to 32 carbon atoms (for example, phenyl, α- or β-naphthyl); an aryldithio group which has from 6 to 32 carbon atoms; or an aryloxy group which has from 6 to 22 carbon atoms. Furthermore, the groups $R^5$, $R^6$ and $R^7$ described above may be optionally substituted with further $R^5$, $R^6$ and $R^7$ groups or hydroxyl groups.

Among the compounds represented by general formula [II], the hindered phenol compounds represented by the general formula [II'] are preferred. Further, the compounds represented by the general formula [II'] are the most preferred among those represented by the general formulae [I] to [V].

General Formula [II']

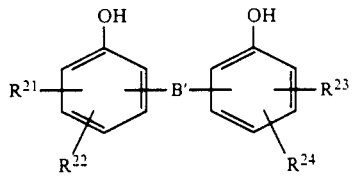

Here, B' represents —S—, —S—S—, —O—, —$CH_2$—S—$CH_2$—, —$SO_2$—, —SO—, —$CH_2$—O—$CH_2$—,

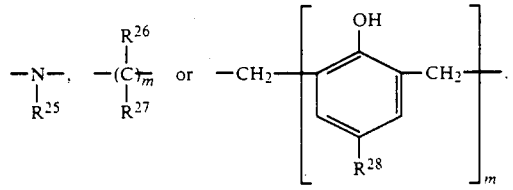

$R^{21}$, $R^{22}$, $R^{23}$ and $R^{24}$ each preferably and independently represents a hydrogen atom; an alkyl group which has from 1 to 20 carbon atoms; an aryl group; an aralkyl group; an alkylthio group; a halogen atom; an alkoxy group; an arylthio group; an aralkoxy group; an aryloxy group; —$COOR^{29}$; —$NHCOR^{29}$; —$NHSO_2R^{29}$; —$SO_2R^{29}$; —O—$COR^{29}$;

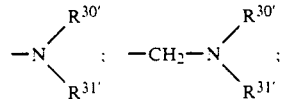

or —$(CH_2)_n$—A'. $R^{25}$ represents a hydrogen atom, an alkyl group or an aryl group; and $R^{26}$ and $R^{27}$ each independently represents a hydrogen atom, an alkyl group or an aryl group, or they may be joined together to form a five or six membered ring. $R^{28}$ represents a hydrogen atom or methyl group. $R^{29}$ represents an alkyl group or an aryl group; and $R^{30'}$ and $R^{31'}$ each independently represents a hydrogen atom, an alkyl group, an aryl group, a heterocyclic group or an aralkyl group, or they may be joined together to form a five or six membered heterocyclic ring which has optional substituents as described earlier.

A' represents an ester group or

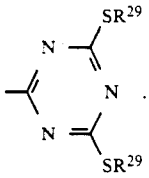

Moreover, m and n represent integers of from 1 to 3.

General Formula [III]

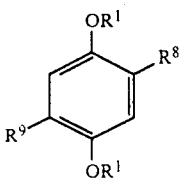

In this formula, $R^8$ preferably represents a hydrogen atom; a linear or branched chain alkyl group which has from 1 to 22 carbon atoms (for example, methyl, ethyl, t-butyl, t-octyl, i-propyl, t-pentyl, t-hexyl, n-octadecyl, 3-methyl-3-pentyl, 3-ethyl-3pentyl); or a linear or branched chain alkenyl group which has from 3 to 22 carbon atoms (for example, allyl, 1-t-butyl-1-allyl). $R^9$ preferably represents a linear or branched chain alkyl group which has from 1 to 22 carbon atoms (for example, methyl, ethyl, t-butyl, t-octyl, i-propyl, t-pentyl, t-hexyl, n-octadecyl, 3-methyl-3-pentyl, 3-ethyl-3-pentyl); or a linear or branched chain alkenyl group which has from 3 to 22 carbon atoms (for example, allyl, 1-t-butyl-1-allyl), and $R^8$ and $R^9$ may be the same or different. Furthermore, $R^1$ has the same significance as $R^1$ in general formula [I].

Furthermore, either of the above-mentioned substituents $R^8$ and $R^9$ may have an —NHCO— bond within the group.

General Formula [IV]

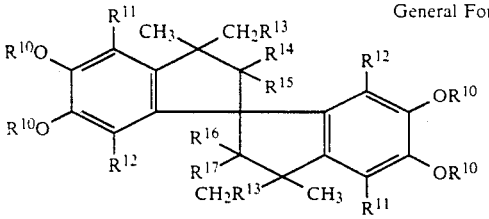

In the formula, $R^{10}$ represents an alkyl group (for example, methyl, ethyl, propyl, n-octyl, tert-octyl, benzyl, hexadecyl); an alkenyl group (for example, allyl, octenyl, oleyl); an aryl group (for example, phenyl, naphthyl); an aralkyl group (for example, benzyl); a heterocyclic group (for example, tetrahydropyranyl, pyrimidyl); or a group which can be represented by $R^{18}CO$, $R^{19}SO_2$ or $R^{20}NHCO$. Here, $R^{18}$, $R^{19}$ and $R^{20}$ each represents an alkyl group (for example, methyl, ethyl, n-propyl, n-butyl, n-octyl, tert-octyl, benzyl); an alkenyl group (for example, allyl, octenyl, oleyl); an aryl group (for example, phenyl, methoxyphenyl, naphthol); or a heterocyclic group (for example, pyridyl, pyrimidyl). $R^{11}$ and $R^{12}$ each represents a hydrogen atom; a halogen atom (for example, fluorine, chlorine, bromine); an alkyl group (for example, methyl, ethyl, n-butyl, benzyl); an alkenyl group (for example, allyl, hexenyl, octenyl); an alkoxy group (for example, methoxy, ethoxy, benzyloxy); or an alkenoxy group (for example, 2-propenyloxy, hexenyloxy). $R^{13}$, $R^{14}$, $R^{15}$, $R^{16}$ and $R^{17}$ independently represent hydrogen atoms; alkyl groups (for example, methyl, ethyl, n-butyl, benzyl); alkenyl groups (for example, 2-propenyl, hexenyl, octenyl); or aryl groups (for example, phenyl, methoxyphenyl, chlorophenyl, naphthyl).

General Formula [V]

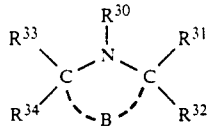

In this formula, B represents a group of non-metal atoms which, together with the adjacent atoms, forms a five to seven membered ring (for example, depending on B, the ring which is formed may be a pyrrolidine ring, piperazine ring, morpholine ring or a piperidine ring). $R^{30}$ represents a hydrogen atom; an alkyl group (for example, methyl, ethyl, n-octyl, benzyl, hexadecyl); an alkenyl group (for example, allyl, oleyl); an alkynyl group (for example, ethynyl, propynyl); an acyl group (for example, acetyl, benzoyl, pentanoyl); a sulfonyl group (for example methanesulfonyl, benzenesulfonyl, toluenesulfonyl, hexadecanesulfonyl); a sulfinyl group (for example, methanesulfinyl, benzenesulfinyl, butanesulfinyl); an oxy radical group; or hydroxyl group. $R^{31}$, $R^{32}$, $R^{33}$ and $R^{34}$ may be the same or different, each representing a hydrogen atom or an alkyl group (for example, methyl, ethyl, butyl).

The formation of a piperidine ring by B is preferred and, most desirably, a piperidine ring is formed by B and at least two of $R^{31}$, $R^{32}$, $R^{33}$ and $R^{34}$ are methyl groups.

Actual examples of compounds represented by the general formulae [I] to [V], including those represented by general formulae [I'] and [II'], which can be used in the invention are indicated below, but the invention is not limited to these examples.

I-1

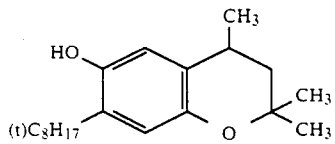

I-2

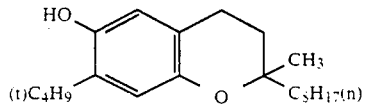

-continued
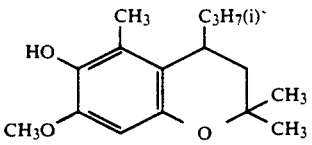
I-3
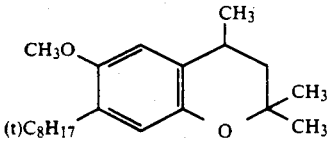
I-4
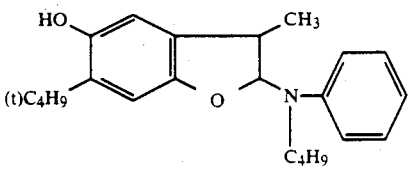
I-5
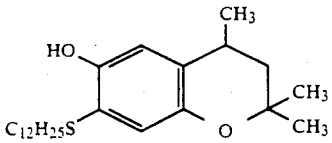
I-6
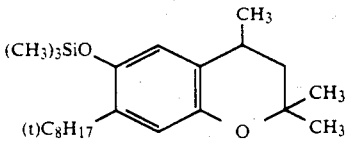
I-7
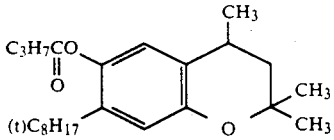
I-8
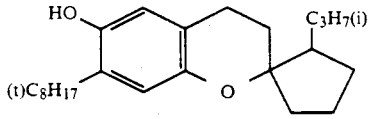
I-9
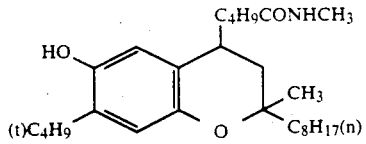
I-10
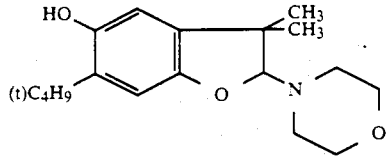
I-11
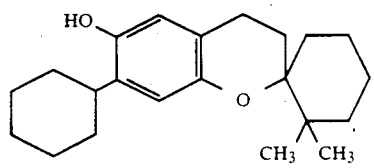
I-12

-continued
I-13
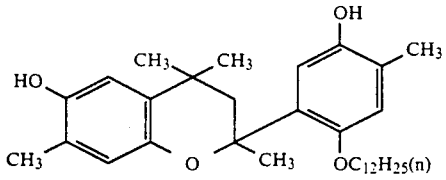
I'-1
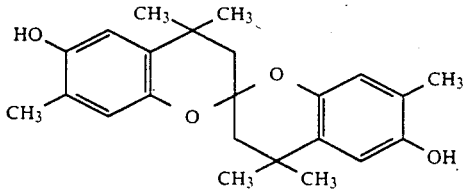
I'-2
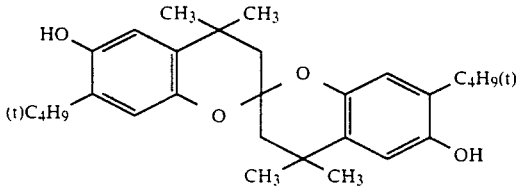
I'-3
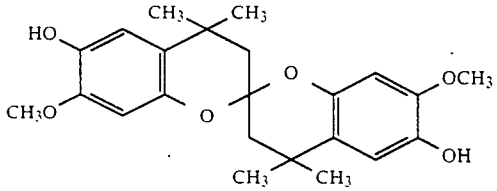
I'-4
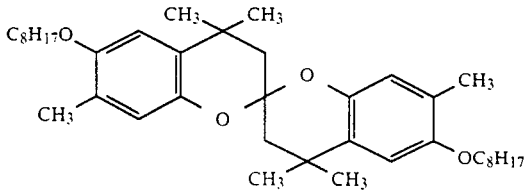
I'-5
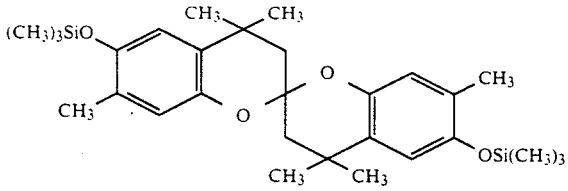
I'-6
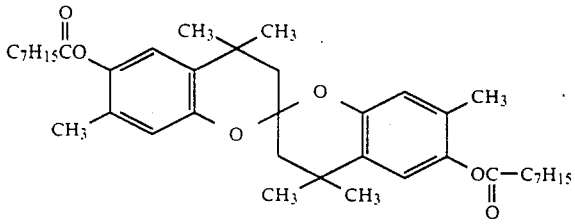
I'-7
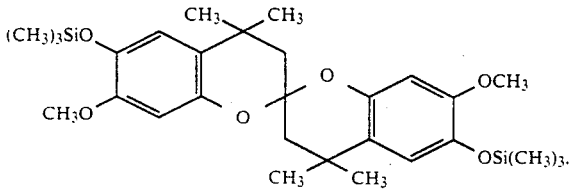

-continued
I'-8
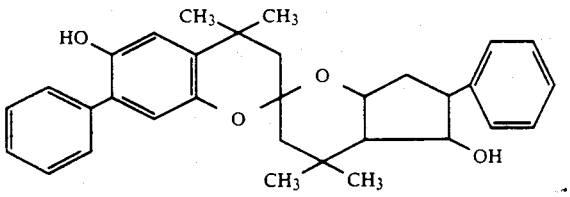
II-1
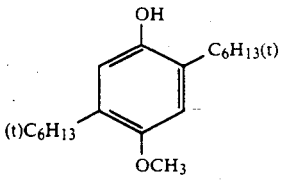
II-2
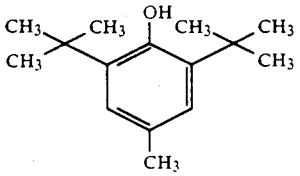
II-3
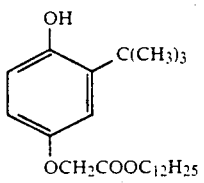
II-4
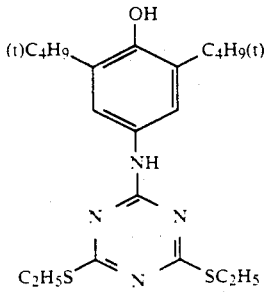
II-5
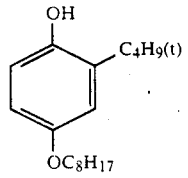
II-6
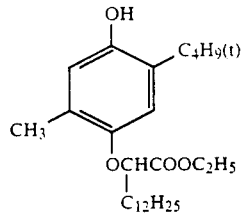
II-7
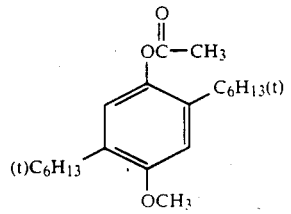

-continued
II-8
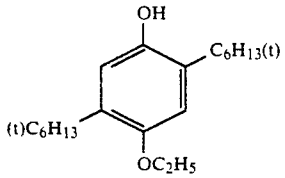
II-9
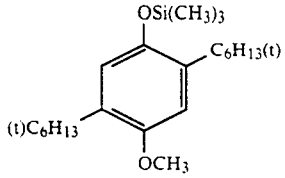
II-10
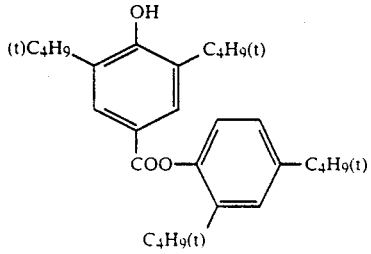
II-11
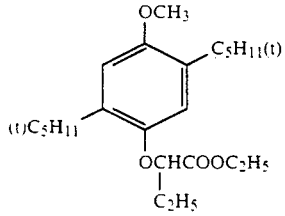
II-12
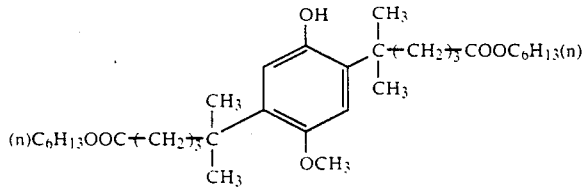
II'-1
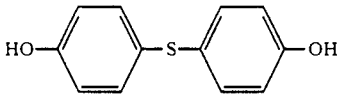
II'-2
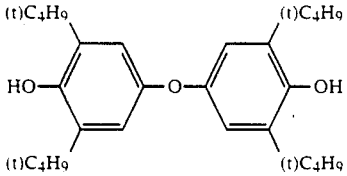
II'-3
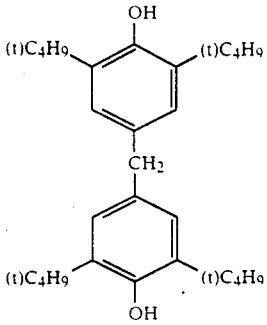

-continued
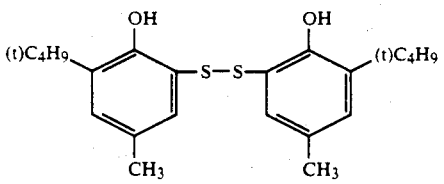
II'-4
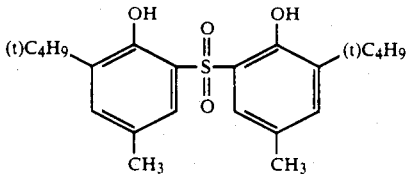
II'-5
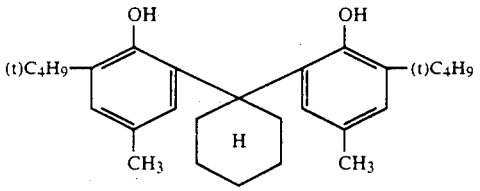
II'-6
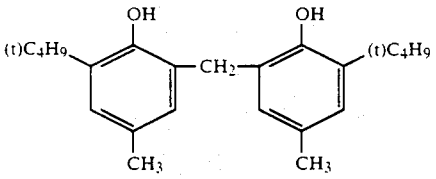
II'-7
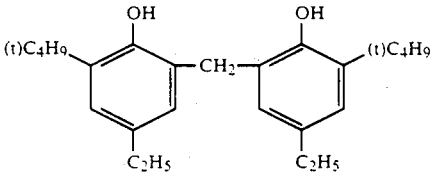
II'-8
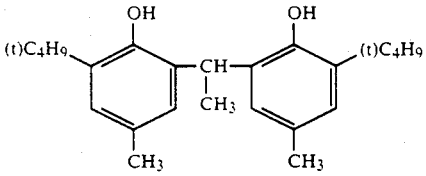
II'-9
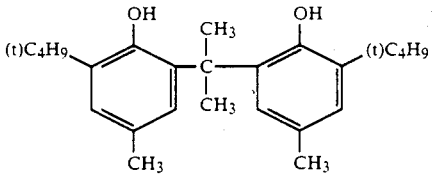
II'-10
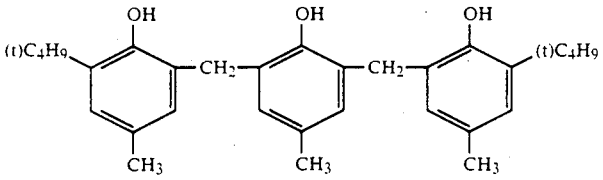
II'-11

-continued
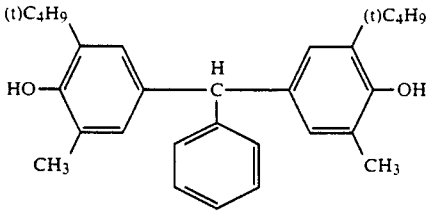
II'-12
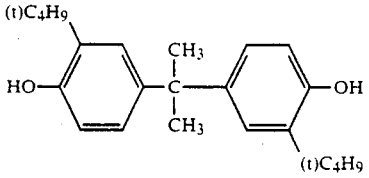
II'-13
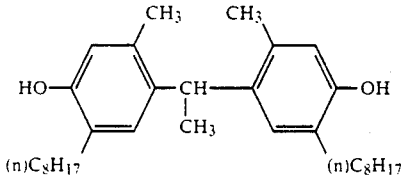
II'-14
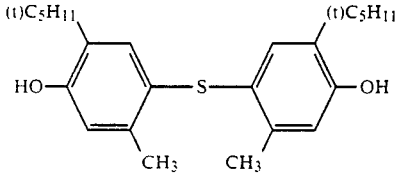
II'-15
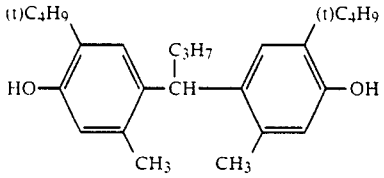
II'-16
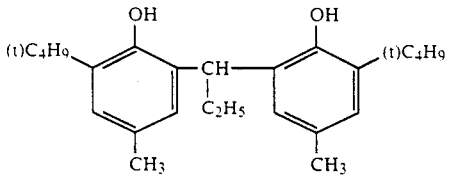
II'-17
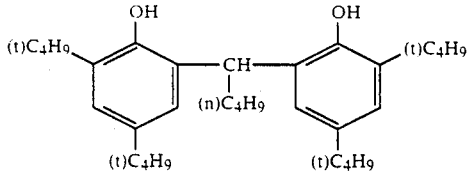
II'-18
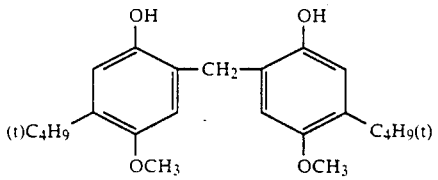
II'-19

-continued
II'-20
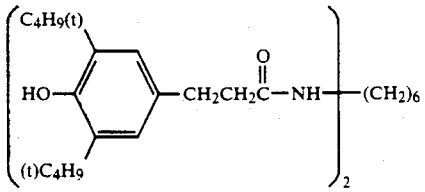
II'-21
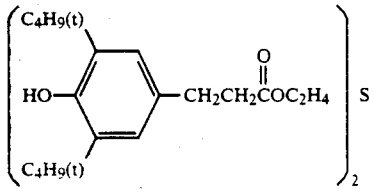
III-1
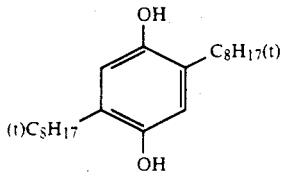
III-2
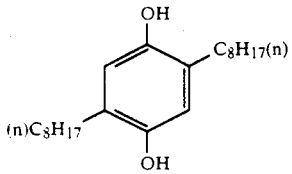
III-3
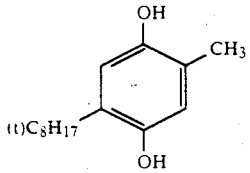
III-4
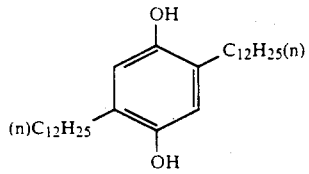
III-5
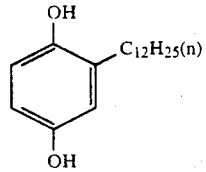
III-6
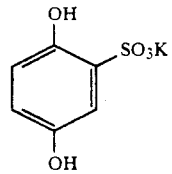
III-7
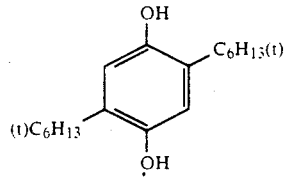

-continued
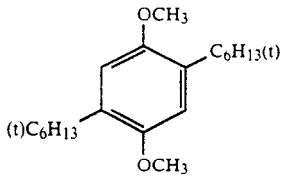
III-8
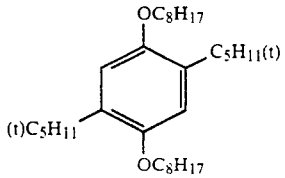
III-9
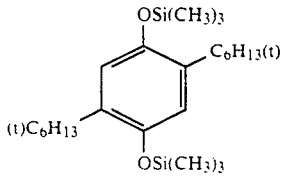
III-10
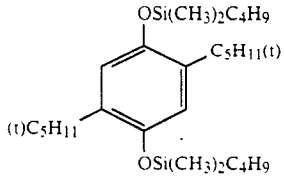
III-11
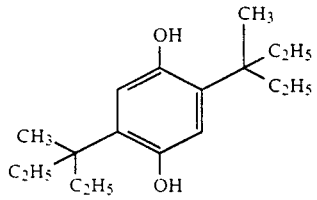
III-12
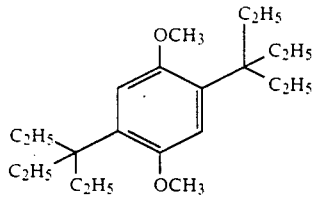
III-13
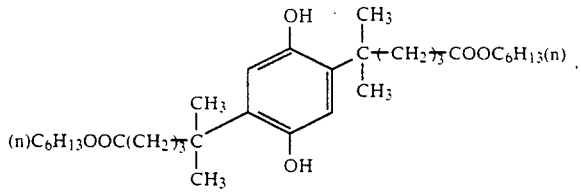
III-14
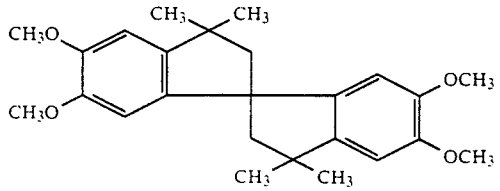
IV-1

-continued
IV-2
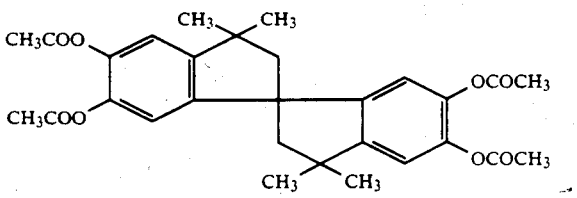
IV-3
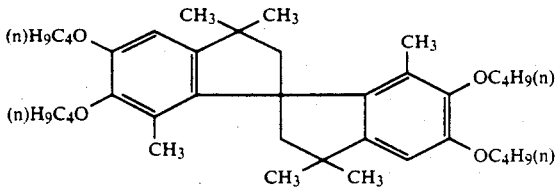
IV-4
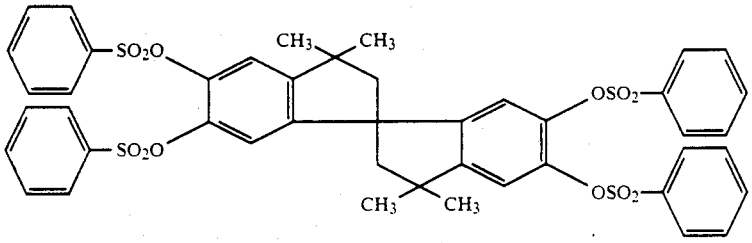
IV-5
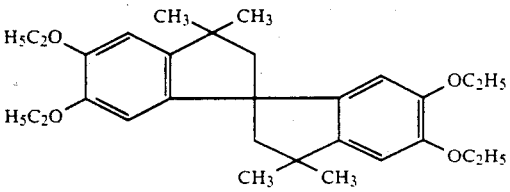
IV-6
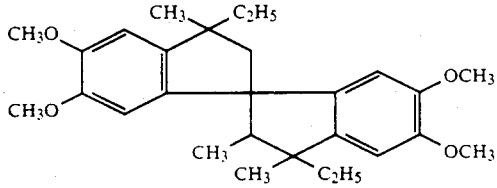
IV-7
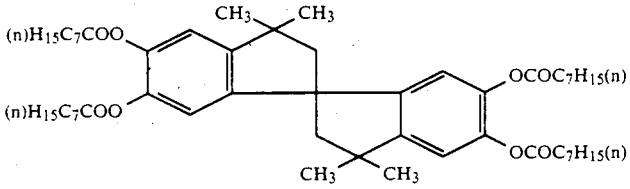
IV-8
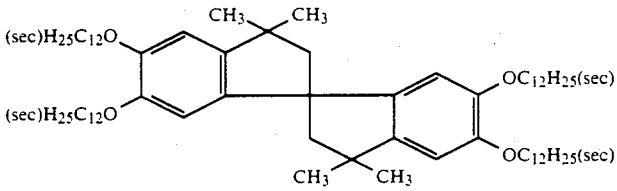
IV-9
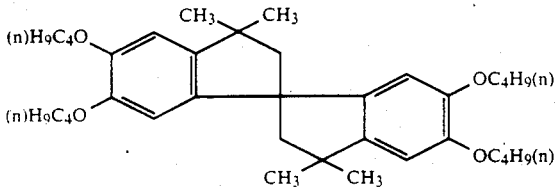

-continued
IV-10
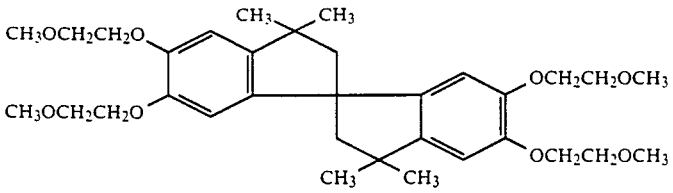
IV-11
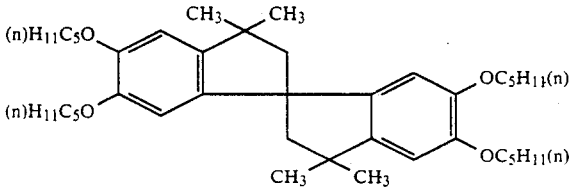
IV-12
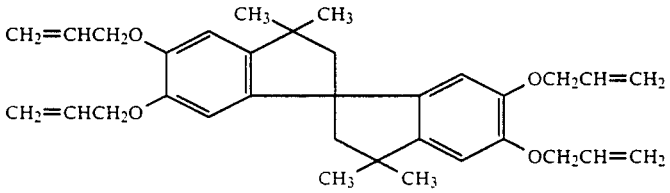
IV-13
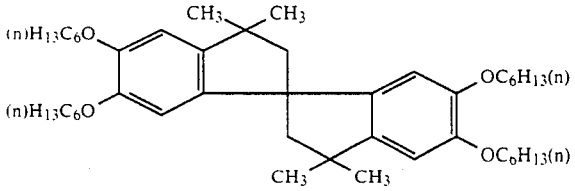
IV-14
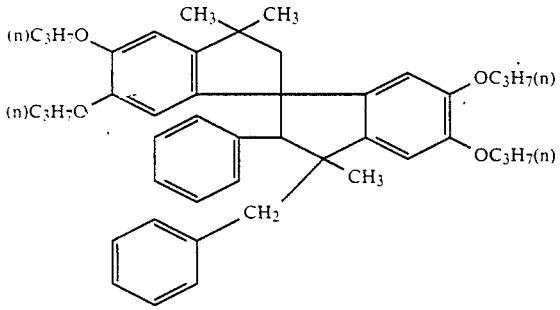
IV-15
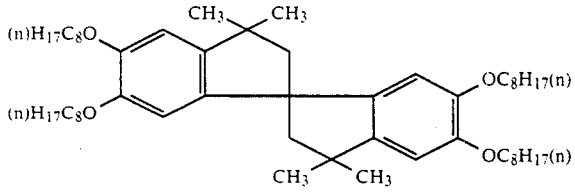
IV-16
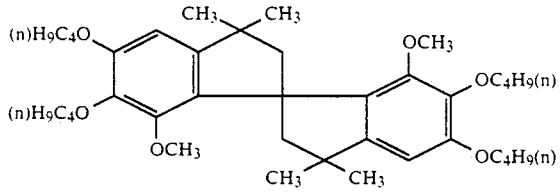
IV-17
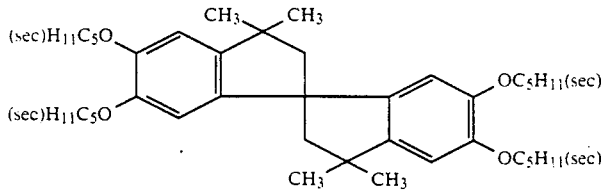

-continued
IV-18
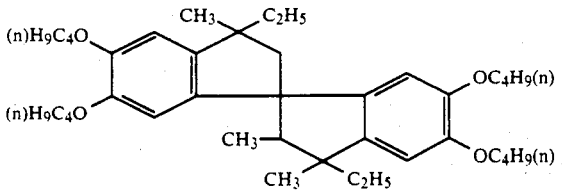
IV-19
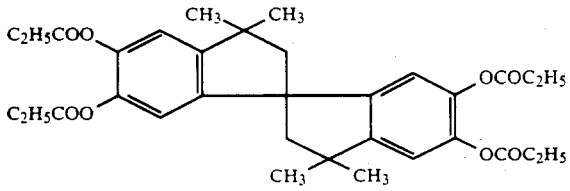
IV-20
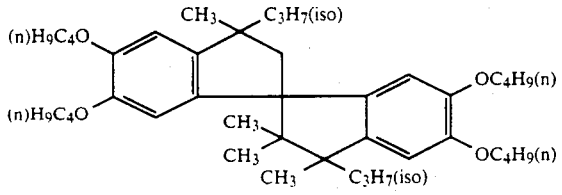
IV-21
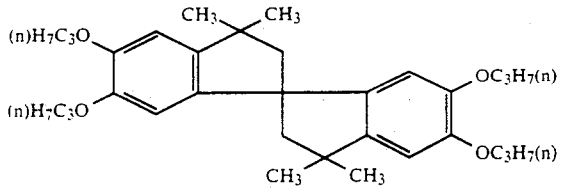
IV-22
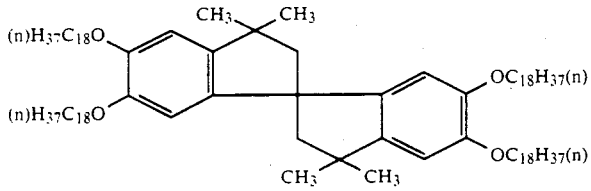
IV-23
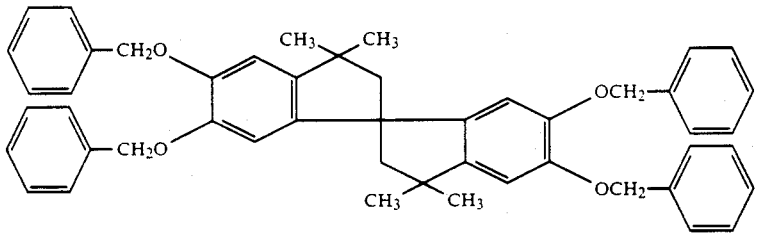
IV-24
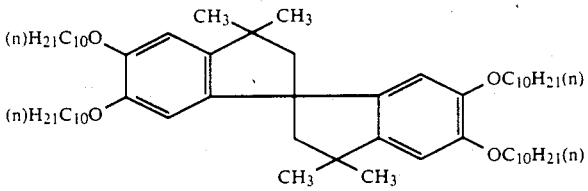
V-1
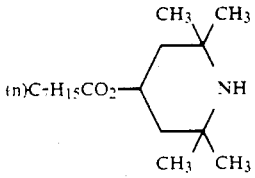

-continued
V-2
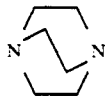
V-3
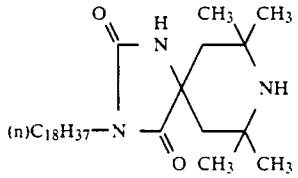
V-4
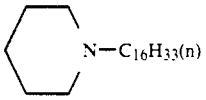
V-5
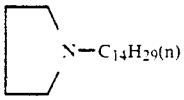
V-6
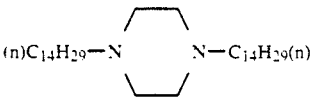
V-7
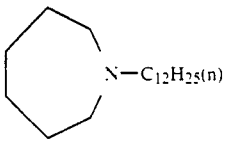
V-8
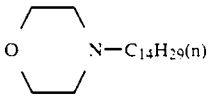
V-9
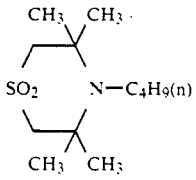
V-10
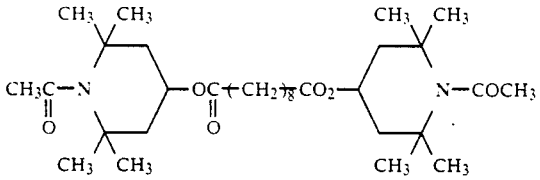

-continued
V-11
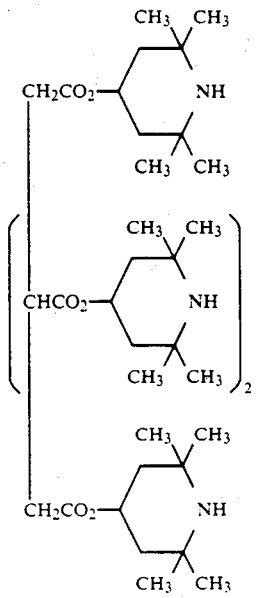
V-12
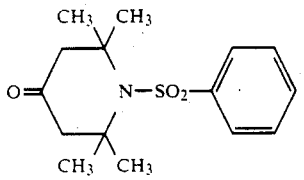
V-13
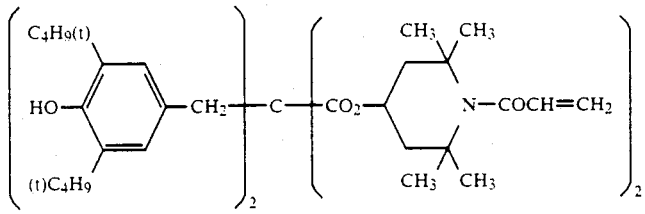
V-14
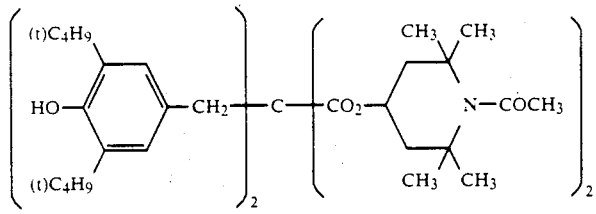
V-15
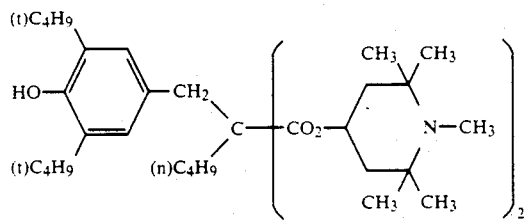
V-16
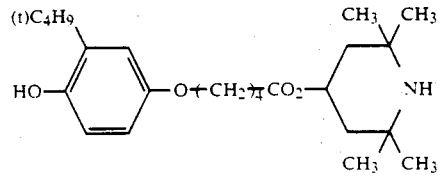

-continued

V-17

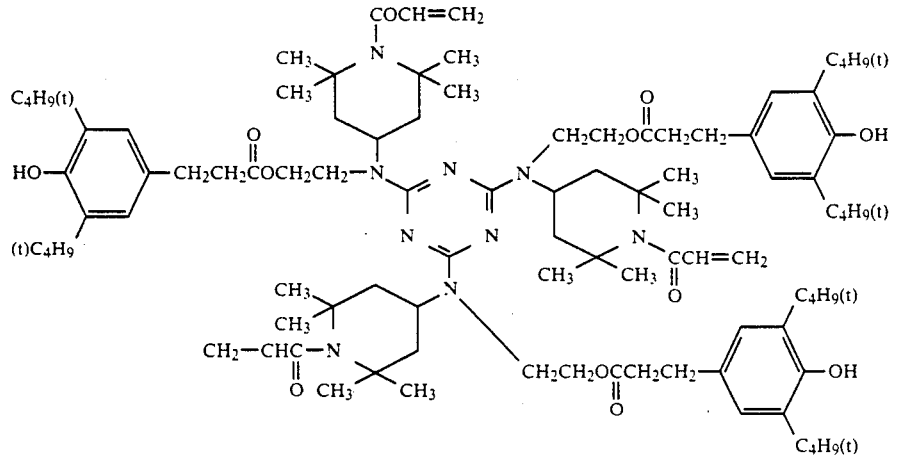

Just one of the chroman based compounds or coumaran based compounds represented by the general formula [I], the phenol based derivatives represented by the general formula [II], or the hydroquinone based derivatives represented by general formula [III], or the spiroindane based derivatives represented by the general formula [IV] or the hindered amine based derivatives represented by general formula [V] can be used, or two or more of these compounds can be used conjointly. Moreover, they can be used conjointly with antioxidants and anti-color fading agents other than those represented by the general formulae [I] to [V], [I'] and [II'].

Moreover, use can also be made, as anti-color fading agents, of the hydroquinone derivatives disclosed, for example, in U.S. Pat. Nos. 2,360,290, 2,418,613, 2,675,314, 2,701,197, 2,704,713, 2,728,639, 2,732,300, 2,735,765, 2,710,801 and 2,816,028 and British Patent 1,363,921; the gallic acid derivatives disclosed, for example, in U.S. Pat. Nos. 3,457,079 and 3,069,262; the p-alkoxyphenols disclosed in U.S. Pat. Nos. 2,735,765 and 3,698,909, JP-B-49-20977 and JP-B-52-6623; and the p-oxyphenol derivatives disclosed in U.S. Pat. Nos. 3,432,300, 3,573,050, 3,574,627 and 3,764,337, JP-A-52-35633, JP-A-52-14743 and JP-A-52-152225, for example. (The term "JP-B" as used herein means an "examined Japanese Patent Publication".)

Furthermore, compounds suitable for anti-fading use can be selected from among a certain variety of metal complexes. The preferred metal complexes are chelate complexes which have at least one ligand selected from among the 1 to 4 coordinate ligands. Actual embodiments of these chelating complexes include those coordinated with two bidentate ligands, those coordinated with one tridentate ligand and one unidentate ligand, and those coordinated with a single tetradentate ligand.

Nitrogen, oxygen, sulfur and halogen (for example, chlorine, bromine, iodine) atoms are the preferred coordinating atoms.

The transition metals, which is to say the metals from scandium, atomic number 21, to zinc, atomic number 30; from yttrium, atomic number 39 to cadmium, atomic number 48; from lanthanum, atomic number 57, to mercury, atomic number 80; and those of atomic number 89 (actinium) or above are effective as the metal which is required in the complex. Among these metals, copper, cobalt, nickel, palladium and platinum are preferred.

Metal complexes wherein the complex (complex group) as a whole forms an anion, or in which the electrical charge is neutralized within the complex, are preferred. The counter cation when an anionic complex is formed is preferably a univalent or divalent cation.

Univalent and divalent cations include, for example, alkali metal ions ($LI^+$, $Na^+$, $K^+$), alkaline earth metal ions ($Mg^{2+}$, $Ca^{2+}$, $Sr^{2+}$, $Ba^{2+}$), bis-onium ions (bisammonium ion or bisphosphonium ion), and onium ions (quaternary ammonium ion, quaternary phosphonium ion, tertiary sulfonium ion).

Transition metal complexes are themselves often colored with a peak absorption in the visible wavelength band, but when they are colored this can give rise to staining of the dye fixing layer and so the anti-color fading agents which are included in the dye fixing layer are preferably colorless, or substantially colorless compounds.

The metal complexes represented by the general formulae (1-I), (2-I) to (2-IV), (3-I) and (3-II) below are colorless or substantially colorless anti-color fading agents.

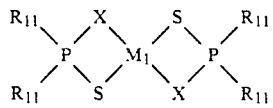

(1-I)

In formula (1-I) above, $M_1$ is Cu, Co, Ni, Pd or Pt; X is 0 or S, $R_{11}$ represents an alkyl group, an aryl group, an alkoxy group or an aryloxy group, provided that the $R_{11}$ groups which are bonded to the same phosphorus atom may be joined together to form, together with the phosphorus atom, a six membered ring.

Details of these complexes have been disclosed in columns 3 to 6 of the specification of U.S. Pat. No. 4,241,155, and the compounds indicated below are specific examples of such complexes.

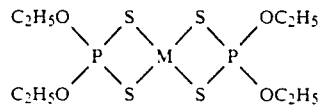

(1-1)

(M = Ni, Co, Cu, Pd or Pt)

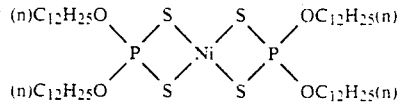

(1-2)

-continued

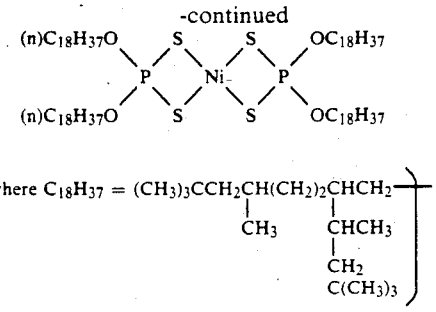

(1-3)

(2-I)

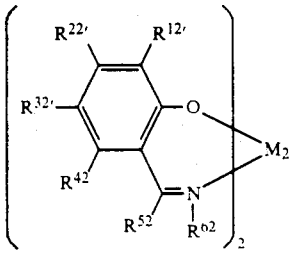

(2-II)

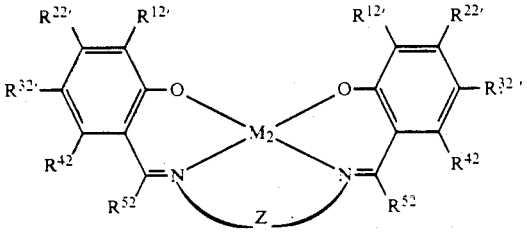

(2-III)

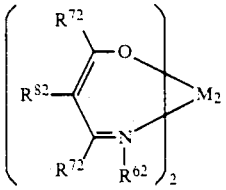

(2-IV)

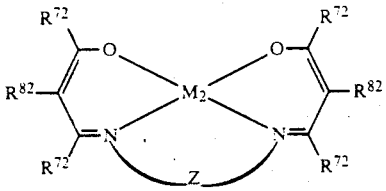

In formulae (2-I) to (2-IV) above, $M_2$ has the same significance as $M_1$. $R^{12'}$, $R^{22'}$, $R^{32'}$ and $R^{42}$ each independently represent a hydrogen atom, halogen atom, cyano group, alkyl group, aryl group, cycloalkyl group or heterocyclic group, and these atoms or groups are bonded to carbon atoms on the benzene rings either directly or via divalent linking groups.

$R^{12'}$ and $R^{22'}$, $R^{22'}$ and $R^{32'}$, or $R^{32'}$ and $R^{42}$, may be jointed together to form a six membered ring.

$R^{52}$ and $R^{82}$ each independently represents a hydrogen atom, alkyl group or aryl group.

$R^{62}$ represents a hydrogen atom, alkyl group, aryl group or hydroxyl group.

$R^{72}$ represents an alkyl group or aryl group. Z represents a group of non-metal atoms required to form a five or six membered ring.

Details of these metal complexes have been disclosed in columns 3 to 36 of the specification of U.S. Pat. No. 4,245,018, and the compounds indicated below are specific examples of these complexes.

(2-1)

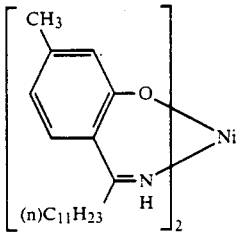

(2-2)

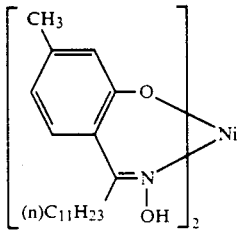

(2-3)

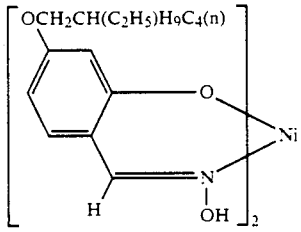

(2-4)

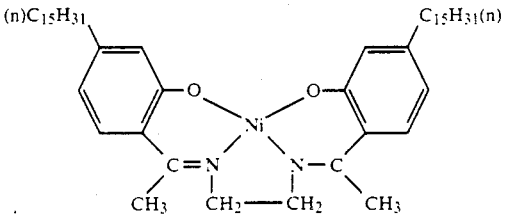

(3-I)

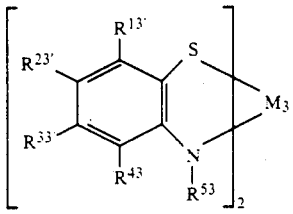

(3-II)

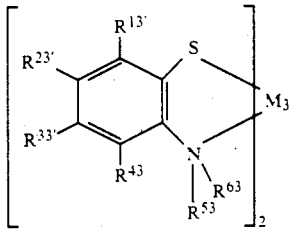

In formulae (3-I) and (3-II) above, $M_3$ has the same significance as $M_1$ in general formula (1-I), and $R^{13'}$, $R^{23'}$, $R^{33'}$ and $R^{43}$ have the same significance as $R^{12'}$, $R^{22'}$, $R^{32'}$ and $R^{42}$ in general formulae (2-I) to (2-IV), respectively. $R^{53}$ and $R^{63}$ each independently represent a hydrogen atom, alkyl group, aryl group, acyl group, alkoxycarbonyl group, aryloxycarbonyl group, alkylsulfonyl group or arylsulfonyl group.

Details of these complexes have been disclosed in columns 3 to 8 of the specification of U.S. Pat. No. 4,254,195, and the compounds indicated below are specific examples of these complexes.

(3-1)

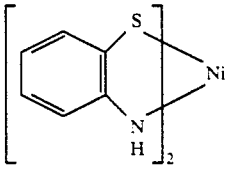

(3-2)

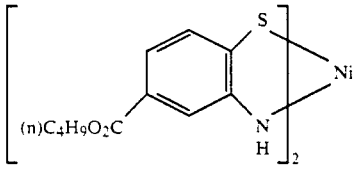

(3-3)

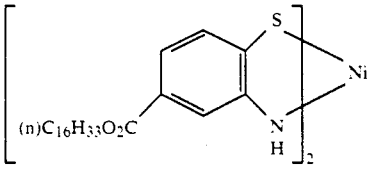

(4-I)

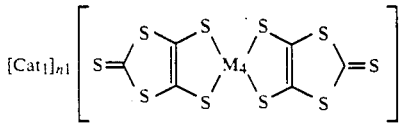

(4-II)

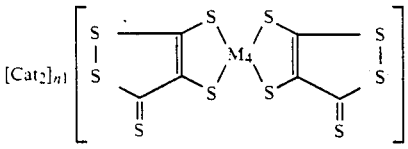

In these formulae, $[Cat_1]$ and $[Cat_2]$ indicate cations which are needed to neutralize the complex, and $M_4$ has the same significance as $M_1$. Moreover, $n_1$ represents 1 or 2.

(4-III)

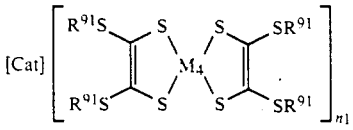

(4-IV)

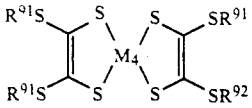

Here, [Cat] represents a cation which is needed to neutralize the complex, $n_1$ represents 1 or 2, and $M_4$ has the same significance as $M_1$.

$R^{91}$ represents a substituted or unsubstituted alkyl group, aryl group or heterocyclic group, and the two $R^{91}$ groups attached to the same ligand can be joined together to form a ring.

Details of these compounds have been disclosed in JP-A-62-174741, and the compounds indicated below are specific examples of these compounds.

(4-1)

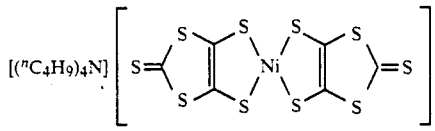

(4-2)

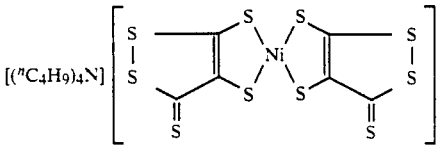

(4-3)

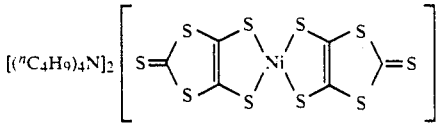

(4-4)

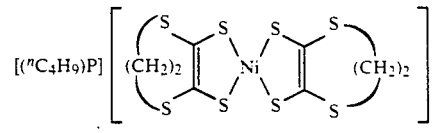

(4-5)

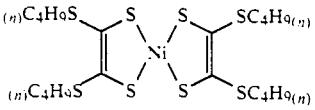

(5-I)

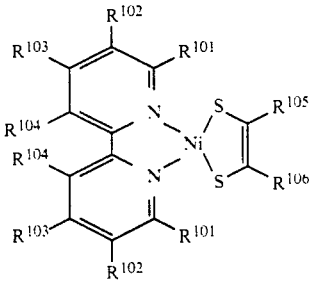

In formula (5-I), $R^{101}$ to $R^{104}$ each independently represents a hydrogen atom, halogen atom, cyano group, hydroxyl group, an alkyl group which is bonded directly, or indirectly via a divalent linking group, to a carbon atom of the pyridine ring, aryl group, cycloalkyl group or heterocyclic group, and these groups may be the same or different. Furthermore, two adjacent groups from among $R^{101}$ to $R^{104}$ can be joined together to from a ring. Furthermore, the two $R^{104}$ groups may be joined together to form a ring.

$R^{105}$ and $R^{106}$ independently represent hydrogen atoms, alkyl groups, alkylthio groups, aryl groups, arylthio groups, heterocyclic thio groups or cyano groups, and they may be the same or different, and $R^{105}$ and $R^{106}$ may be joined together to form a ring.

(5-II)

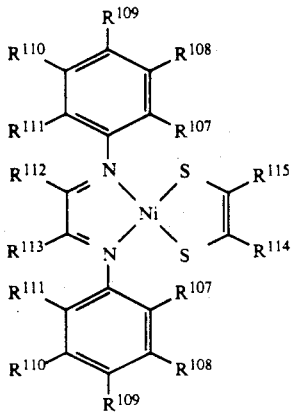

(5-III)

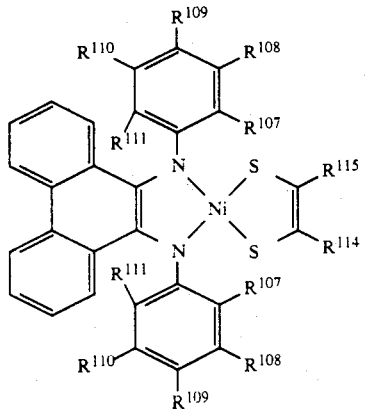

(5-IV)

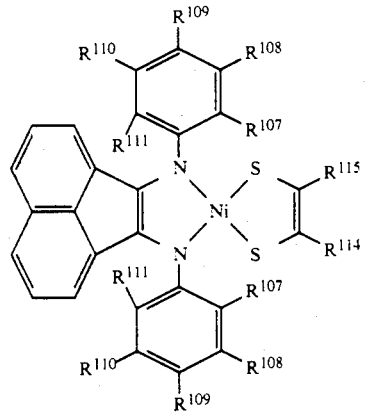

In these formulae, $R^{107}$ to $R^{111}$ independently represent halogen atoms, hydrogen atoms, alkyl groups which are bonded directly, or indirectly via a divalent linking group, to a carbon atom of the benzene ring, aryl groups, cycloaklyl groups or heterocyclic groups, and they may be the same or different. Furthermore, adjacent substituents among these groups can be joined together to form a ring. $R^{112}$ and $R^{113}$ independently represent alkyl groups or aryl groups, and these may be the same or different. $R^{114}$ and $R^{115}$ represent hydrogen atoms, alkyl groups, aryl groups or cyano groups and they may be the same or different, or $R^{114}$ and $R^{115}$ may be joined together to form a ring.

Details of general formula (5-I) have been disclosed in JP-A-63-199248. The compounds indicated below are specific examples of these compounds.

(5-1)

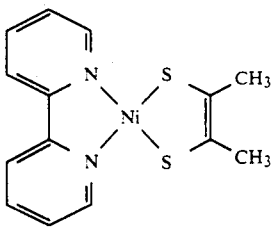

(5-2)

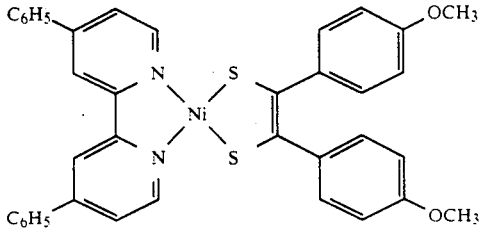

(5-3)

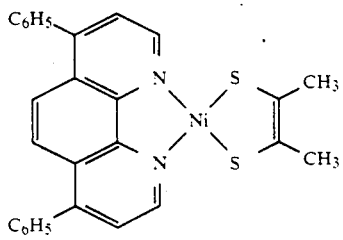

(5-4)

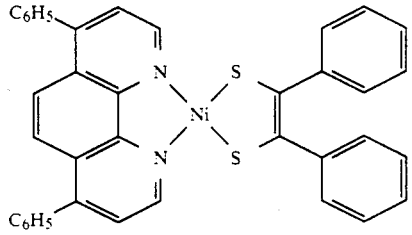

(5-5)

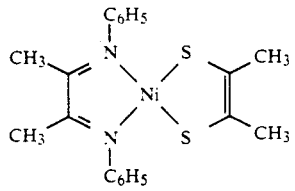

(5-6)

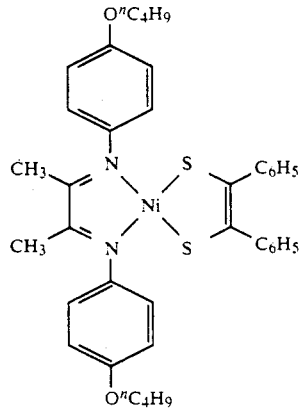

-continued (5-7)

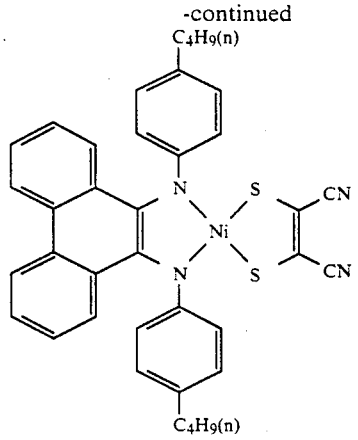

(6-I)

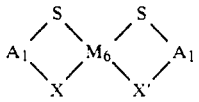

(6-II)

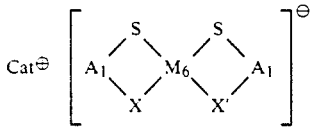

In these formulae, $M_6$ has the same significance as $M^1$, X and X' each independently represents a member selected from the group consisting of sulfur and oxygen, and $Cat^{+}$ represents a cation. $A_1$ represents a group which can be represented by the following formulae:

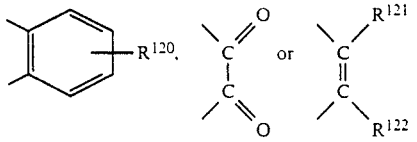

In these formulae, $R^{120}$ represents a hydrogen atom or alkyl group, and $R^{121}$ and $R^{122}$ each independently represents a hydrogen atom, phenyl group, substituted phenyl group, nitrile group and an alkyl group.

Details of these compounds have been disclosed in JP-A-50-87649, and the compounds indicated below are specific examples of these compounds.

(6-1)

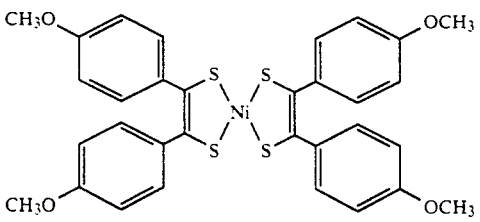

(6-2)

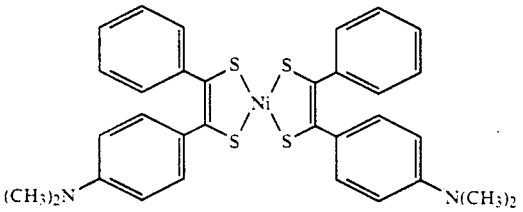

-continued (6-3)

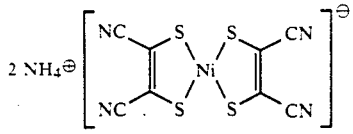

(6-4)

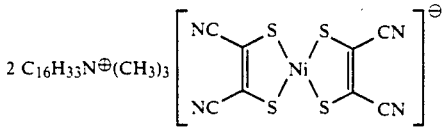

(6-5)

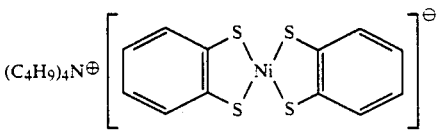

The compounds of this invention can be used conjointly with other antioxidants and ultraviolet absorbers.

The ultraviolet absorbers include benzotriazole based compounds (for example, those described in U.S. Pat. No. 3,533,794); 4-thiazolidone based compounds (for example, those described in U.S. Pat. No. 3,352,681); benzophenone based compounds (for example, those described in JP-A-46-2784); and other compounds as disclosed, for example, in JP-A-54-48535, JP-A-62-136641 and JP-A-61-88256. The ultraviolet absorbing polymers disclosed in JP-A-62-260152 are also effective.

Photosensitive elements of this invention comprise basically photosensitive silver halides, binders, and dye providing substances provided on a support. They can also contain organometallic salt oxidizing agents, etc. as required. These components are often added to the same layer, but if they are reactive they can be added separately to different layers. For example, if colored dye providing compounds are present below the silver halide emulsion layer, then reduction of photographic speed is prevented. The incorporation of reducing agents into the photosensitive element is preferred, but they may be provided from an external source, using, for example, the method of diffusion from the dye fixing element described hereinafter.

Combinations of at least three silver halide emulsion layers which are photosensitive to different regions of the spectrum are used to obtain a wide range of colors in the chromaticity diagram using the three colors yellow, magenta and cyan. For example, there are three layer combinations consisting of a blue sensitive layer, a green sensitive layer and a red sensitive layer, and combinations consisting of a green sensitive layer, a red sensitive layer and an infrared sensitive layer.

The photosensitive layers can be arranged in the various sequences known for the ordinary types of color photosensitive material.

Furthermore, each of these photosensitive layers may be divided into two or more layers, as required.

Various auxiliary layers, such as protective layers, subbing layers, interlayers, yellow filter layers, antihalation layers and backing layers for example, can be established in the photosensitive element.

The silver halide which may be used in the present invention may be any of silver chloride, silver bromide, silver iodobromide, silver chlorobromide, silver chloroiodide and silver chloroiodobromide.

The silver halide emulsion used in the present invention may be a surface latent image type emulsion or an internal latent image type emulsion. The internal latent image type emulsion may be used as a direct reversal emulsion in combination with a nucleating agent or a light fogging agent. Alternatively, the silver halide emulsion may be a core/shell emulsion in which the interior and the surface of the grain are different from each other in phase. The silver halide emulsion may be a monodisperse or polydisperse emulsion or a mixture thereof. The grain size of the emulsion is preferably in the range of from 0.1 to 2 μm, particularly from 0.2 to 1.5 μm. The crystal habit of the silver halide grains may be cubic, octahedral, tetradecahedral or tabular with a high aspect ratio.

In particular, photosensitive silver halide emulsions as described in U.S. Pat. Nos. 4,500,626 and 4,628,021, *Research Disclosure,* No. 17029 (1978), and JP-A-62-253159 may be used in the present invention.

The silver halide emulsion may be used unripened but is normally used after being chemically sensitized. For emulsions for the photosensitive materials, known sulfur sensitization processes, reduction sensitization processes and noble metal sensitization processes may be used singly or in combination. These chemical sensitization processes may be optionally effected in the presence of a nitrogen-containing heterocyclic compound as disclosed in JP-A-62-253159.

The amount of the photosensitive silver halide emulsion coated is in the range of from 1 mg to 10 g/m$^2$ (calculated in terms of amount of silver).

The silver halide used in the present invention may be conventionally spectrally sensitized with a methine dye or the like. Examples of such dyes include cyanine dyes, merocyanine dyes, complex cyanine dyes, complex merocyanine dyes, holopolar cyanine dyes, hemicyanine dyes, styryl dyes and hemioxonol dyes.

Specific examples of dyes include sensitizing dyes as described in U.S. Pat. No. 4,617,257, JP-A-59-180550, JP-A-60-140335, and *Research Disclosure,* No. 17029 (1978), pp. 12–13.

These sensitizing dyes may be used singly or in combination. In particular, combinations of sensitizing dyes are often used for the purpose of supersensitization.

The photosensitive silver halide emulsion may comprise a dye which does not exhibit a spectral sensitizing effect by itself or a compound which does not substantially absorb visible light but exhibits a supersensitizing effect (as described in U.S. Pat. No. 3,615,641 and JP-A-63-23145) together with such a sensitizing dye.

Such sensitizing dyes may be incorporated in the emulsion during, before or after chemical sensitization. Alternatively, the sensitizing dye may be incorporated in the emulsion before or after the nucleation of photosensitive silver halide grains as described in U.S. Pat. Nos. 4,183,756 and 4,225,666. The amount of sensitizing dye incorporated is normally in the range of from $10^{-8}$ to $10^{-2}$ mol per mol of photosensitive silver halide.

In the present invention, organometallic salts may be used as oxidizing agents in combination with the photosensitive silver halide. Among such organometallic salts, organic silver salts are particularly preferably used.

Examples of organic compounds which can be used to form such an organic silver salt oxidizing agent include benzotriazoles, fatty acids, and other compounds as described in U.S. Pat. No. 4,500,626 (52nd column to 53rd column). Other useful examples of such organic compounds include carboxylic acid silver salts containing an alkynyl group such as silver phenylpropiolate as described in JP-A-60-113235, and silver acetylide as described in JP-A-61-249044. These organic silver salts may be used in combination.

These organic silver salts are generally used in an amount of from 0.01 to 10 mols, preferably from 0.01 to 1 mol, per mol of photosensitive silver halide. The total amount of photosensitive silver salt and organic silver salt coated is preferably in the range of from 50 mg to 10 g/m$^2$ (calculated in terms of amount of silver).

In the present invention, various fog inhibitors or photographic stabilizers may be used. Examples of such fog inhibitors or photographic stabilizers include azoles or azaindenes as described in *Research Disclosure,* No. 17643 (1978), pp. 24–25, nitrogen-containing carboxylic acids or phosphoric acids as described in JP-A-59-168442, mercapto compounds and metal salts thereof as described in JP-A-59-111636, and acetylenic compounds as described in JP-A-62-87957.

As suitable reducing agents for the present invention there may be used conventional reducing agents known in the field of heat developable photosensitive materials. Alternatively, reducing dye-providing compounds as described later may be used. These reducing dye-providing compounds may be used in combination with other reducing agents. Further, a reducing agent precursor which does not exhibit a reducing effect but undergoes reaction with a nucleophilic reagent or under heating to exhibit a reducing effect may be used in the present invention.

Examples of reducing agents used in the present invention include reducing agents or reducing agent precursors as described in U.S. Pat. No. 4,500,626 (49th column to 50th column), U.S. Pat. No. 4,483,914 (30th column to 31st column), U.S. Pat. Nos. 4,330,617, and 4,590,152, JP-A-60-140335, JP-A-57-40245, JP-A-56-138736, JP-A-59-178458, JP-A-59-53831, JP-A-59-182449, JP-A-59-182450, JP-A-60-119555, JP-A-60-128436, JP-A-60-128437, JP-A-60-128438, JP-A-60-128439, JP-60-198540, JP-A-60-181742, JP-A-61-259253, JP-A-62-244044, JP-A-62-131253, JP-A-62-131254, JP-A-62-131255, and JP-A-62-131256, and European Patent 220,746A2 (pp. 78–96).

Combinations of various reducing agents as disclosed in U.S. Pat. No. 3,039,869 may also be used in the present invention.

If a non-diffusible reducing agent is used, an electron transfer agent and/or electron transfer agent precursor may optionally be used in combination therewith in order to accelerate the transfer of electrons between the non-diffusible reducing agent and the developable silver halide.

Such an electron transfer agent or its precursor may be selected from the above described reducing agents or precursors thereof. Such an electron transfer agent or its precursor is preferably greater than the non-diffusible reducing agent (electron donor) in mobility. Particularly useful electron transfer agents are 1-phenyl-3-pyrazolidones or aminophenols.

As non-diffusible reducing agents (electron donors) used in combination with such an electron transfer agent there may be used any of the above described reducing agents which are substantially non-diffusible in the layer of photosensitive element in which they are located. Preferred examples of such non-diffusible reducing agents include hydroquinones, sulfonamidophenols, sulfonamidonaphthols, compounds described as electron donors in JP-A-53-110827, and non-diffusible reducing dye-providing compounds as later described.

In the present invention, the amount of such reducing agent(s) incorporated is preferably in the range of from 0.001 to 20 mols, particularly from 0.01 to 10 mols per mol of total silver.

In the present invention, as an image-forming substance, a compound which produces or releases a mobile dye in correspondence or counter correspondence to the reduction of silver ions to silver, i.e., dye-providing compounds, may be incorporated in the photosensitive material.

Examples of such dye-providing compounds which may be used in the present invention include compounds which undergo an oxidation coupling reaction with a color developing agent to form a dye (coupler). Such a coupler may be a two-equivalent coupler or four-equivalent coupler. A two-equivalent coupler containing a nondiffusible group as a split-off group which undergoes oxidation coupling reaction to form a diffusible dye is preferably used. Specific examples of suitable developing agents and couplers are described in T. H. James, *The Theory of the Photographic Process*, pp. 291–334 and 354–361, JP-A-58-123533, JP-A-58-149046, JP-A-58-149047, JP-A-59-111148, JP-A-59-124399, JP-A-59-174835, JP-A-59-231539, JP-A-59-231540, JP-A-60-2950, JP-A-60-2951, JP-A-60-14242, JP-A-60-23474, and JP-A-60-66249.

Examples of different dye-providing compounds include compounds which serves to imagewise release or diffuse a diffusible dye. Such a compound can be represented by the following general formula (LI):

$$(\text{Dye}—\text{Y})_n—\text{Z} \qquad \text{(LI)}$$

wherein Dye represents a dye group, a dye group which has been temporarily shifted to a short wavelength range or a dye precursor group; Y represents a mere bond or connecting group; Z represents a group which makes a difference in the diffusibility of the compound represented by $(\text{Dye}—\text{Y})_n—\text{Z}$ in corresponding or counter-corresponding to photosensitive silver salts having a latent image distributed imagewise or releases Dye in corresponding or counter-corresponding to photosensitive silver salts having a latent image distributed imagewise to make no difference in the diffusibility between Dye thus released and $(\text{Dye}—\text{Y})_n—\text{Z}$; and n represents an integer of 1 or 2. If n is 2, two (Dye—Y)'s may be the same or different.

Specific examples of the dye-providing compound represented by the general formula (LI) include the following compounds i to v. The compounds i to iii form a diffusible dye image (positive dye image) in counter-corresponding to the development of silver halide while the compounds iv and v form a diffusible dye image (negative dye image) in corresponding to the development of silver halide.

i. Dye developing agents comprising a hydroquinone developing agent connected to a dye component as described in U.S. Pat. No. 3,134,764, 3,362,819, 3,597,200, 3,544,545, and 3,482,972. These dye developing agents are diffusible in alkaline conditions but become nondiffusible upon reaction with silver halide.

ii. Nondiffusible compounds which release a diffusible dye in alkaline conditions but lose their function upon reaction with silver halide as described in U.S. Pat. No. 4,503,137. Examples of such compounds include compounds which undergo intramolecular nucleophilic displacement reactions to release a diffusible dye as described in U.S. Pat. No. 3,980,479, and compounds which undergo an intramolecular rewinding reaction of the isooxazolone ring to release a diffusible dye as described in U.S. Pat. No. 4,199,354.

iii. Nondiffusible compounds that react with a reducing agent left unoxidized after being developed to release a diffusible dye as described in U.S. Pat. No. 4,559,290, European Patent 220,746A2, and Kokai Giho 87-6,199.

Examples of such compounds include compounds which undergo intramolecular nucleophilic displacement reaction after being reduced to release a diffusible dye as described in U.S. Pat. Nos. 4,139,389 and 4,139,379, and JP-A-59-185333, and JP-A-57-84453, compounds which undergo an intramolecular electron transfer reaction after being reduced to release a diffusible dye as described in U.S. Pat. No. 4,232,107, JP-A-59-101649, JP-A-61-88257, and *Research Disclosure*, No. 24,025 (1984), compounds which undergo cleavage of a single bond after being reduced to release a diffusible dye as described in West German Patent 3,008,588A, JP-A-56-142530, and U.S. Pat. Nos. 4,343,893, and 4,619,884, nitro compounds which receive electrons to release a diffusible dye as described in U.S. Pat. No. 4,450,223, and compounds which receive electrons to release a diffusible dye as described in U.S. Pat. No. 4,609,610.

Preferred examples of such compounds include compounds containing an N13 X bond (wherein X represents oxygen atom, sulfur atom or nitrogen atom) and an electrophilic group in one molecule as described in European Patent 220,746A2, Kokai Giho 87-6,199, JP-A-63-201653, and JP-63-201654, compounds containing an $SO_2$—X group (wherein X is as defined above) and an electrophilic group in one molecule as described in U.S. application Ser. No. 07/188,779, compounds containing a PO—X bond (wherein X is as defined above) and an electrophilic group in one molecule as described in JP-A-63-271344, and compounds containing a C—X' bond (wherein X' is as defined above for X or represent —$SO_2$—) and an electrophilic group in one molecule as described in JP-A-63-271341.

Particularly preferred among these compounds are compounds containing an N—X bond and an electrophilic group in one molecule. Specific examples of such compounds include Compounds (1) to (3), (7) to (10), (12), (13), (15), (23) to (26), (31), (32), (35), (36), (40), (41), (44), (53) to (59), (64), and (70) described in European Patent 220,746A2, and Compounds (11) to (23) described in Kokai Giho 87-6,199.

iv. Couplers containing a diffusible dye as the split-off group which reacts with an oxidation product of a reducing agent to release a diffusible dye (DDR coupler). Specific examples of such compounds include those described in British Patent 1,330,524, JP-B-48-39165, and U.S. Pat. Nos. 3,443,940, 4,474,867, and 4,483,914.

v. Compounds which are capable of reducing silver halide or organic silver salts and release a diffusible dye after reducing silver halide or organic silver salts (DDR compound). These compounds are advantageous in that they need no other reducing agents. They eliminate image staining due to the action of oxidation decomposition products of reducing agents. Typical examples of such compounds are described in U.S. Pat. Nos.

3,928,312, 4,053,312, 4,055,428, 4,336,322, 3,725,062, 3,728,113, 3,443,939, and 4,500,626, JP-A-59-65839, JP-A-59-69839, JP-A-53-3819, JP-A-51-104343, JP-A-58-116537, JP-A-57-179840, and *Research Disclosure*, No. 17,465. Specific examples of DRR compounds include compounds as described in U.S. Pat. No. 4,500,626, 22nd column to 44th column, and particularly preferred among these compounds are compounds (1) to (3), (10) to (13), (16) to (19), (28) to (30), (33) to (35), (38) to (40), and (42) to (64). Other preferred examples of such compounds include those described in U.S. Pat. No. 4,639,408, 37th column to 39th column.

Examples of dye-providing compounds other than the above described couplers and compounds of the general formula [LI] include silver halide dye compounds comprising an organic silver salt connected to a dye as described in *Research Disclosure* (May 1978, pp. 54–58), azo dyes for use in heat developable silver dye bleaching processes as described in U.S. Pat. No. 4,235,957 and *Research Disclosure* (April 1976, pp. 30–32), and leuco dyes as described in U.S. Pat. Nos. 3,985,565 and 4,022,617.

The incorporation of a hydrophobic additive such as a dye-providing compound or a non-diffusible reducing agent in a layer of photosensitive element can be accomplished by any known method as described in U.S. Pat. No. 2,322,027. In this case, a high boiling organic solvent as described in JP-A-59-83154, JP-A-59-178451, JP-A-59-178452, JP-A-59-178453, JP-A-59-178454, JP-A-59-178455, and JP-A-59-178457 may optionally be used in combination with a low boiling organic solvent having a boiling point of from 50° to 160° C.

The amount of such a high boiling organic solvent incorporated is generally in the range of from 1 to 10 g, preferably 5 g or less, per gram of dye-providing compound used or 1 cc or less, preferably 0.5 cc or less, particularly preferably 0.3 cc or less, per gram of binder.

A dispersion process as described in JP-B-51-39853 and JP-A-51-59943 which comprises using a polymerization produce may also be used.

If a compound which is substantially insoluble in water is used, it may be incorporated in the binder in the form of dispersion of finely divided particles rather than by the above described processes.

In order to disperse a hydrophobic compound in a hydrophilic cooloid, various surface active agents can be used. Examples of such surface active agents which may be used in this dispersion process include those described as surface active agent in JP-A-59-157636 (pp. 37–38).

In the present invention, a compound which serves both to accelerate the development of photosensitive materials and stabilize images may be used. Specific examples of such compounds preferably used in the present invention are described in U.S. Pat. No. 4,500,626 (51st column to 52nd column).

In a system where the diffusion transfer of a dye(s) is used to form images, a dye fixing element is used in combination with the photosensitive element. Such a dye fixing element may be either coated on a separate support from the photosensitive element or coated on the same support as the photosensitive element. For the relationship of the photosensitive element with the dye fixing element, the support and a white reflecting layer which can be used, those described in U.S. Pat. No. 4,500,626 (57th column) are useful.

The dye fixing element preferably used in the present invention may comprise at least one layer containing a mordant and a binder. As such mordants there may be used those known in the field of photography. Specific examples of such mordants include those described in U.S. Pat. No. 4,500,626 (58th column to 59th column), JP-A-61-88256 (pp. 32–41), JP-A-62-244043 and JP-A-62-244036. Alternatively, a dye-receiving high molecular weight compound as described in U.S. Pat. No. 4,463,079 may be used.

The dye fixing element may optionally comprise auxiliary layers such as a protective layer, strippable layer or anti-curling layer. Particularly, a protective layer can be advantageously incorporated in the dye fixing element.

As suitable binders incorporated in the photosensitive element or dye fixing element there may be used a hydrophilic binder. Examples of such hydrophilic binders include those described in JP-A-62-253159 (pp. 26–28). Specific examples of such hydrophilic binder include transparent or semi-transparent hydrophilic binders such as proteins (e.g., gelatin, gelatin derivative), polysaccharides (e.g., cellulose derivatives, starch, gum arabic, dextran, pullulan), and synthetic high molecular compounds (e.g., polyvinyl alcohol, polyvinylpyrrolidone, acrylamide polymers). Alternatively, a high water-absorbing polymer as described in JP-A-62-245260, i.e., a homopolymer of a vinyl monomer containing —COOM or —$SO_3M$ (wherein M represents a hydrogen atom or alkali metal) or a copolymer of such vinyl monomers or such a vinyl monomer with other vinyl monomers (e.g., sodium methacrylate, ammonium methacrylate, SUMIKAGEL® L-5H made by Sumitomo Chemical Co., Ltd.) may be used. These binders may be used singly or in combination.

In a system wherein heat development is effected with a slight amount of water, the above described high water-absorbing polymer may be used to expedite the absorption of water. Such a high water-absorbing polymer may be incorporated in the dye fixing layer or in a protective layer therefor to prevent dye which has been transferred from being re-transferred from the dye fixing element to other elements.

In the present invention, the amount of the binder coated is preferably in the range of 20 g or less, more preferably 10 g or less, particularly 7 g or less per $m^2$.

Example of film hardeners which may be incorporated in the constituent layers of the photosensitive element or dye fixing element include those described in U.S. Pat. No. 4,678,739 (41st column), JP-A-59-116655, JP-A-62-245261, and JP-A-61-18942. Specific examples of such film hardeners include aldehyde film hardeners (e.g., formaldehyde), aziridene film hardeners, epoxy film hardeners (e.g.,

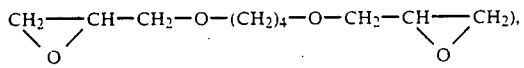

vinylsulfone film hardeners (e.g., N,N'-ethylenebis(-vinylsulfonylacetamido)ethane), N-methylol film hardeners (e.g., dimethylol urea), and high molecular film hardeners (e.g., compounds as described in JP-A-62-234157), In the present invention, the photosensitive element and/or dye fixing element may include an image formation accelerator. Such an image formation accelerator serves to accelerate a redox reaction between a silver salt oxidizing agent and a reducing agent, accelerate production or decomposition of a dye from a dye providing compound or release of a diffusible dye from the dye providing compound, or accelerate transfer of a dye from a photosensitive material layer to a dye fixing layer. From the physicochemical standpoint, image formation accelerators can be classified into various groups such as base or base precursor, nucleophilic compound, high boiling organic solvent (oil), thermal solvent, surface active agent, and compounds capable of interacting with silver or silver ion. However, these groups normally have composite functions and therefore exhibit a combination of the above described accelerating effects. Details are given in U.S. Pat. No. 4,678,739 (38th column to 40th column).

Examples of such base precursors include salts of an organic acid capable of being heat-decarboxylated with a base, and compounds which undergo an intramolecular nucleophilic displacement reaction, Lossen rearrangement or Beckman rearrangement to release an amine. Specific examples of such base precursors are described in U.S. Pat. No. 4,511,493 and JP-A-62-65038.

In a system where heat development and dye transfer are simultaneously effected in the presence of a small amount of water, such a base and/base precursor may be preferably incorporated in the dye fixing element to improve the storage stability of the photosensitive element.

Other examples of suitable base precursors include a combination of a sparingly soluble metallic compound and a compound capable of complexing with metal ions constituting said metallic compound as described in European Patent 210,660A, and a compound as described in JP-A-61-232451 which undergoes electrolysis to produce a base. Particularly, the former compound may be effectively used. The sparingly soluble metallic compound and the complexing compound may advantageously be incorporated separately in the photosensitive element and the dye fixing element.

The present photosensitive element and/or dye fixing element may comprise various development stopping agents for the purpose of providing images resistant against fluctuations in temperature and time for development.

The term "development stopping agent" as used herein means a compound which readily neutralizes or reacts with a base to reduce the base concentration in the film to stopping development, or which interacts with silver or silver salt to inhibit development, after a proper development period. Specific examples of such compounds include acid precursors which release an acid on heating, electrophilic compounds which undergo a displacement reaction with a base present therewith on heating, and nitrogen-containing heterocyclic compounds, mercapto compounds and precursors thereof.

Details are given in JP-A-62-253159 (pp. 31–32).

The constituent layers (including the backing layer) of the photosensitive element or dye fixing element may comprise various polymer latexes for the purpose of dimensional stability, inhibiting curling, adhesion, film cracking and pressure sensitization or desensitization or improving other film properties. Specific examples of suitable polymer latexes which may be used include those described in JP-A-62-245258, JP-A- 62-136648, and JP-A-62-110066. In particular, if a polymer latex having a low glass transition point (40° C. or lower) is incorporated in the mordant layer, cracking of the mordant layer can be prevented. If a polymer latex having a high glass transition point is incorporated in the backing layer, an anticurling effect can be provided.

The constituent layers of the photosensitive element or dye fixing element may comprise a high boiling organic solvent as a plasticizer, lubricant or agent for improving the strippability of the photosensitive element from the dye fixing element. Specific examples of such a high boiling organic solvent include those described in JP-A-62-253159 (page 25) and JP-A-62-245253.

For the above described purposes, various silicone oils ranging from dimethyl silicone oil to modified silicone oil obtained by incorporating various organic groups into dimethylcycloxane may be used. For example, various modified silicone oils, particularly carboxy-modified silicone (trade name: X-22-3710), described at pp. 6–8 of "Modified Silicone Oil", technical data reported by Shin-Etsu Silicone Co., Ltd., may be effectively used.

Silicone oils as described in JP-A-62-215953 and JP-A-63-46449 may also be effectively used.

The photosensitive element or dye fixing element may comprise a fluorescent brightening agent. In particular, such a fluorescent brightening agent may be incorporated in the dye fixing element or supplied into the dye fixing element from other elements such as photosensitive element. Examples of such fluorescent brightening agents include compounds as described in K. Veenkataraman, *The Chemistry of Synthetic Dyes*, Vol. V, Chapter 8, and JP-A-61-143752. Specific examples of such compounds include stilbene compounds, coumarin compounds, biphenyl compounds, benzoxazolyl compounds, naphthalimide compounds, pyrazoline compounds, and carbostyryl carboxy compounds.

Such a fluorescent brightening agent may be used in combination with a discoloration inhibitor.

The constituent layers of the photosensitive element or dye fixing element may comprise various surface active agents for the purpose of aiding of coating, improving strippability and lubricity, inhibiting static electrification or accelerating development. Specific examples of such surface active agents are described in JP-A-62-173463 and JP-A-62-183457.

The constituent layers of the photosensitive element or dye fixing element may comprise an organofluoro compound for the purpose of improving lubricity and strippability or inhibiting static electrification. Typical examples of such an organofluoro compound include fluorine surface active agents as described in JP-B-57-9053 (8th column to 17th column), JP-A-61-20944, and JP-A-62-135826, and hydrophobic fluorine compounds such as oily fluorine compounds (e.g., fluorine oil) or solid fluorine compound resins (e.g., tetrafluoroethylene resin).

The photosensitive element or dye fixing element may comprise a matt agent. Examples of such a matt agent include compounds as described in JP-A-61-88256 (pp. 29) (e.g., silicon dioxide, polyolefin, polymethacrylate) and compounds as described in JP-A-63-279944 and JP-A-63-274952 (e.g., benzoguanamine resin beads, polycarbonate resin beads, AS resin beads).

Furthermore, the constituent layers of the photosensitive element or dye fixing element may comprise a thermal solvent, an anti-foaming agent, an anti-bacterial and anti-fungal agent or colloidal silica. Specific examples of these additives are described in JP-A-61-88256 (pp. 26–32).

As a suitable support for the dye fixing element or photosensitive element, there may be used a material capable of withstanding the processing temperature. In general, paper or a synthetic high molecular weight compound (film) may be used. Specific examples of such a support material which may be used in the present invention include polyethylene terephthalate, polycarbonates, polyvinyl chloride, polystyrene, polypropylene, polyimides or celluloses (e.g., triacetyl cellulose) or a material obtained by incorporating a pigment such as titanium oxide in such a film, a synthetic paper film formed of polypropylene or the like, a mixed paper made of synthetic resin pulp such as polyethylene and natural pulp, Yankee paper, baryta paper, coated paper (particularly cast coat paper), metals, fabrics, and glass.

Such a support material may be used as it is or in the form of a material laminated with a synthetic high molecular weight compound such as polyethylene on one or both sides thereof.

Alternatively, a support material as described in JP-A-62-253159 (pp. 29–31) may be used in the present invention.

These support materials may be coated with a hydrophilic binder, a semiconducting metal oxide such as alumina sol or tin oxide, carbon black or other antistatic agents.

Examples of process for exposing the photosensitive element to light for imaging include processes which comprise using a camera to photograph scenery or persons, processes which comprise using a printer or enlarger to expose the photosensitive material to light through a reversal film or negative film, processes which comprise using an exposing machine such as a copying machine to effect scanning exposure of the photosensitive material to an original through a slit, processes which comprise exposing the photosensitive material to light representative of image data emitted by a light emitting diode or various lasers, and processes which comprise exposing the photosensitive material directly or through an optical system to light representative of image data emitted by an image display apparatus such as a CRT, liquid crystal display, electroluminescence display or plasma display.

As a light source for recording images on the photosensitive material there may be used natural light, tungsten lamp, a light emitting diode, a laser, a CRT or light sources as described in U.S. Pat. No. 4,500,626 (56th column).

Furthermore, light of a wavelength where the wavelength of the light source has been modulated with a non-linear optical element can also be used. In this case, it is possible to obtain easily light of a wavelength in the blue region which previously had been difficult to obtain with laser light or LED's.

Examples of image data which can be recorded on the present photosensitive material include picture signals from a video camera, electron still camera or the like, a television signal according to Nippon Television Signal Code (NTSC), a picture signal obtained by dividing an original into many pixels by means of a scanner or the like, and a picture signal produced by means of a CG, CAD or like computer.

The heating temperature at which heat development can be effected is preferably in the range of from about 50° C. to about 250° C., particularly from about 80° C. to about 180° C. The dye diffusion transfer process may be effected simultaneously with or after heat development. In the latter case, the heating temperature at which dye transfer can be effected is preferably in the range of from the heating temperature for heat development to room temperature, particularly from 50° C. to a temperature about 10° C. lower than the heating temperature for heat development.

The transfer of a dye can be effected by heating alone. In order to accelerate the dye transfer, a solvent may be used.

Alternatively, a process as described in JP-A-59-218443 and JP-A-61-238056 which comprises heating the photosensitive material in the presence of a small amount of a solvent, particularly water, to effect development and dye transfer simultaneously or in sequence may be effectively used. The heating temperature for this process is preferably in the range of from 50° C. to a temperature not higher than the boiling point of the solvent. For example, if the solvent is water, the heating temperature is preferably in the range of from 50° C. to 100° C.

Examples of a solvent which may be used to accelerate development and/or transfer of a diffusible dye to the dye fixing layer include water and a basic aqueous solution containing an inorganic alkali metal salt or organic base as described with reference to the image formation accelerators. Other useful examples of solvents include a low boiling solvent and a mixed solution made of such a low boiling solvent and water or a basic aqueous solution. Such a solvent may further comprise a surface active agent, fog inhibitor, sparingly soluble metal salt, complexing compound or the like.

These solvents may be incorporated in either or both of the photosensitive element and the dye fixing element. The amount of the solvent incorporated in the photosensitive element and/or dye fixing element may be small such as not more than the weight of the solvent in a volume corresponding to the maximum swelling volume of the total coated films (particularly, not more than the value obtained by subtracting the weight of the entire coated film(s) from the weight of the solvent in a volume corresponding to the maximum swelling volume of the entire coated film(s)) in the photosensitive or dye fixing solvent.

As the process for incorporating the solvent in the photosensitive layer or dye fixing layer, those described in JP-A-61-147244 (page 26) can be referenced. Alternatively, the solvent may be incorporated in either or both of the photosensitive element and the dye fixing element in a microcapsule form or like form.

In order to accelerate transfer of a dye, a hydrophilic thermal solvent which stays solid at normal temperature but dissolves at an elevated temperature may be incorporated in the photosensitive element or dye fixing element. Such a hydrophilic thermal solvent may be incorporated in either or both of the photosensitive element and the dye fixing element. The layer in which the solvent is incorporated may be any one of emulsion layer, interlayer, protective layer and dye fixing layer, preferably the dye fixing layer and/or a layer adjacent thereto.

Examples of such a hydrophilic thermal solvent include ureas, pyridines, amides, sulfonamides, imides, anisoles, oximes and other heterocyclic compounds.

In order to accelerate the transfer of a dye, a high boiling organic solvent may be incorporated in the photosensitive element and/or dye fixing element.

Examples of heating processes at development and/or the dye transfer step include processes which comprise bringing the photosensitive material into contact with a heated block or plate, processes which comprise bringing the photosensitive material into contact with a heating plate, hot presser, heat roller, halogen lamp heater, infrared or far infrared lamp heater or the like, and processes which comprises passing the photosensitive material through a high temperature atmosphere. Alternatively, the photosensitive element or dye fixing element may be provided with a resistive heating element layer so that it is heated by passing an electric current through the resistive heating element layer. As such a resistive heating element layer there may be used the one described in JP-A-61-145544.

As the pressure conditions and pressure application processes for the lamination of the photosensitive element and the dye fixing element, those described in JP-A-61-147244 (p. 27) can be used.

For the photographic processing of the photographic element, any suitable heat developing apparatus may be employed.

Examples of such a heat developing apparatus preferably used in the present invention include those described in JP-A-59-75247, JP-A-59-177547, JP-A-59-181353, JP-A-60-18951, and JP-A-U-62-25944 (the term "JP-A-U" as used herein means an "unexamined published Japanese utility model application").

EXAMPLE 1

An image receiving material R-1 was prepared by coating with the various layers indicated in Table 1. Unless otherwise indicated, all parts, percents, ratios etc. are by weight.

TABLE 1

Structure of the Image Receiving Material R-1

| Layer Number | Materials Added | Amount ($g/m^2$) |
|---|---|---|
| Third Layer | Gelatin | 0.05 |
| | Film hardening agent (2)* | 0.20 |
| | Silicone oil (1)* | 0.04 |
| | Surfactant (1)* | 0.001 |
| | Surfactant (2)* | 0.02 |
| | Surfactant (3)* | 0.10 |
| | Matting agent (1)* | 0.02 |
| | Guanidine picolinate | 0.45 |
| | Water soluble polymer (1)* | 0.05 |
| Second Layer | Mordant (1)* | 2.0 |
| | Water soluble polymer (1)* | 0.60 |
| | Gelatin | 0.7 |
| | Water soluble polymer (2)* | 0.05 |
| | High boiling point organic solvent (1)* | 0.7 |
| | Guanidine picolinate | 1.80 |
| | Surfactant (4)* | 0.02 |
| First Layer | Gelatin | 0.45 |
| | Surfactant (3)* | 0.01 |
| | Water soluble polymer (1)* | 0.04 |
| | Film hardening agent (2)* | 0.80 |
| Support | Polyethylene layer | 45 μm |
| | Cast coat layer | 10 μm |
| | Coat layer | 10 μm |
| | Plain paper | 60 μm |
| | Coat layer | 10 μm |
| | Polyethylene layer | 35 μm |
| First Backing Layer | Gelatin | 3.25 |
| | Film hardening agent (1)* | 0.25 |
| Second Backing Layer | Gelatin | 0.44 |
| | Silicone oil (1)* | 0.08 |
| | Surfactant (4)* | 0.05 |
| | Matting agent (2)* | 0.09 |
| | Surfactant (5)* | 0.01 |

Silicon Oil (1)*

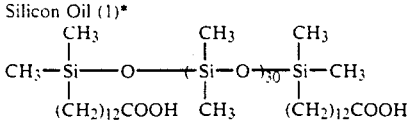

TABLE 1-continued

Surfactant (1)

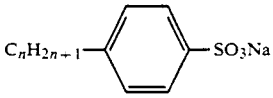

(n = about 12.6)

Surfactant (2)*

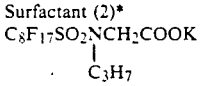

Surfactant (3)*

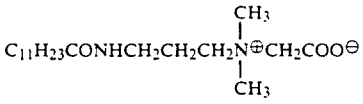

Surfactant (4)*

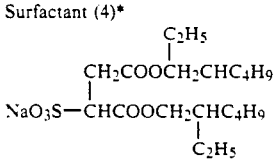

Surfactant (5)*

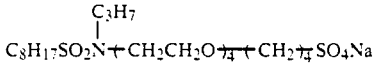

Water Soluble Polymer (1)*
Poly(sodium methacrylate)
Water Soluble Polymer (2)*
Dextran (molecular weight: 70,000)

Mordant (1)*

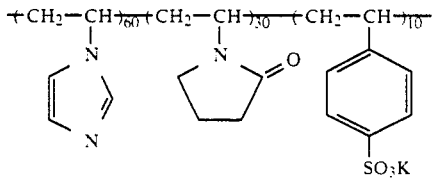

High Boiling Point Organic Solvent (1)*
Rheophos ® 95 (Made by Ajinomoto Co., Inc.)

Film Hardening Agent (1)*

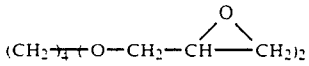

Film Hardening Agent (2)*
1,3-Vinylsulfonyl-2-propanol
Matting Agent (1)*
Silica
Matting Agent (2)*
Benzoguanamine resin (average particle size: 15 μm)
*The high boiling point organic solvent was added as oil droplets.

Preparation and Addition of Oil Droplets

Five ml of a 5% aqueous solution of sodium dodecylbenzenesulfonate were added to 100 grams of a 10% aqueous gelatin solution, 25 grams of Rheophos ® 95 were added thereto and the dispersion of oil droplets obtained by emulsification and dispersion in a homogenizer at 10,000 rpm for a period of 6 minutes was added to the coating liquid for the dye fixing layer (second layer).

Next, image receiving materials (R-2) to (R-6) were prepared in the same way as image receiving material (R-1) except that the compounds indicated below were included in the oil droplets in an amount of 0.5 g/m$^2$.

| | | $k_q \cdot T_1$ ($M^{-1} \cdot sec^{-1}$) | $k_q \cdot O_2$ ($M^{-1} \cdot sec^{-1}$) |
|---|---|---|---|
| R-2 | Compound II'-3 | $2.6 \times 10^6$ | $8.0 \times 10^7$ |
| R-3 | Compound II'-7 | $2.0 \times 10^5$ | $1.5 \times 10^7$ |
| R-4 | Compound II'-20 | $3.5 \times 10^5$ | $2.3 \times 10^7$ |
| R-5 | Compound V-2 | $4.7 \times 10^8$ | $2.4 \times 10^8$ |
| R-6 | Compound 2-2 | — | $3.4 \times 10^9$ |

Furthermore, an image receiving material (R-7) was prepared with the addition of 0.5 g/m$^2$ of compound III-6 as an aqueous solution to the second layer.

| | | $k_q \cdot T_1$ ($M^{-1} \cdot sec^{-1}$) | $k_q \cdot O_2$ ($M^{-1} \cdot sec^{-1}$) |
|---|---|---|---|
| R-7 | Compound III-6 | $1.3 \times 10^6$ | $3.0 \times 10^7$ |

The preparation of the photosensitive materials was achieved in the way described below.

Photosensitive material (K-1) was prepared by coating with the structure shown in Table 2 on a polyethylene terephthalate support.

TABLE 2

Photosensitive Material (K-1)

| Layer Number and Name | Materials Added | Amount (g/m$^2$) |
|---|---|---|
| Sixth Layer (Protective Layer) | Gelatin | 0.91 |
| | Matting agent (silica) | 0.03 |
| | Water soluble polymer (1)* | 0.23 |
| | Surfactant (1)* | 0.06 |
| | Surfactant (2)* | 0.13 |
| | Film hardening agent (1)* | 0.01 |
| | $ZnSO_4.7H_2O$ | 0.06 |
| Fifth Layer (Blue Sensitive Layer) | Emulsion (III) as silver | 0.58 |
| | Gelatin | 0.68 |
| | Sensitizing dye (2) | $1.2 \times 10^{-3}$ |
| | Anti-fogging agent (2)* | $1.36 \times 10^{-3}$ |
| | Yellow dye providing substance (1) | 0.50 |
| | High boiling point organic solvent (1)* | 0.25 |
| | Electron donor (ED-11) | 0.25 |
| | Surfactant (3)* | 0.05 |
| | Electron transfer agent (X-22) | 0.03 |
| | Film hardening agent (1)* | 0.01 |
| | Water soluble polymer (2)* | 0.02 |
| Fourth Layer (Interlayer) | Gelatin | 0.75 |
| | $Zn(OH)_2$ | 0.32 |
| | Reducing agent (ED-37) | 0.11 |
| | Surfactant (1)* | 0.02 |
| | Surfactant (4)* | 0.07 |
| | Water soluble polymer (2)* | 0.02 |
| | Film hardening agent (1)* | 0.01 |
| Third Layer (Green Sensitive Layer) | Emulsion (III) as silver | 0.41 |
| | Gelatin | 0.47 |
| | Anti-fogging agent (1)* | $1.25 \times 10^{-3}$ |
| | Magenta dye providing substance (2) | 0.37 |
| | High boiling point organic solvent (1)* | 0.19 |
| | Electron donor (ED-11) | 0.14 |
| | Surfactant (3)* | 0.04 |
| | Electron transfer agent (X-22) | 0.03 |
| | Film hardening agent (1)* | 0.01 |
| | Water soluble polymer (2)* | 0.02 |
| Second Layer (Interlayer) | Gelatin | 0.80 |
| | $Zn(OH)_2$ | 0.31 |
| | Reducing agent (ED-37) | 0.11 |
| | Surfactant (1)* | 0.06 |
| | Surfactant (4)* | 0.10 |
| | Water soluble polymer (2)* | 0.03 |
| | Film hardening agent (1)* | 0.01 |
| First Layer (Red Sensitive Layer) | Emulsion (I) as silver | 0.36 |
| | Gelatin | 0.49 |
| | Anti-fogging agent (1)* | $1.25 \times 10^{-3}$ |
| | Cyan dye providing substance (3) | 0.37 |
| | High boiling point organic solvent (1)* | 0.18 |
| | Electron donor (ED-11) | 0.14 |
| | Surfactant (3)* | 0.04 |
| | Electron transfer agent (X-22) | 0.03 |
| | Film hardening agent (1)* | 0.01 |
| | Water soluble polymer (2)* | 0.02 |
| Support | (Polyethylene terephthalate: Thickness 100 μm) | |
| Backing Layer | Carbon black | 0.44 |
| | Polyester | 0.30 |
| | Poly(vinyl chloride) | 0.30 |

Water Soluble Polymer (1)*
Sumikagel ® L-5 (H) Made by Sumitomo Chemical Co., Ltd.
Water Soluble Polymer (2)*

TABLE 2-continued
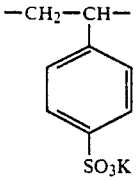
(molecular weight: about 800,000)
Surfactant (1)*
Aerosol ® OT
Surfactant (2)*
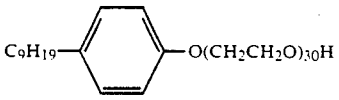
Surfactant (3)*
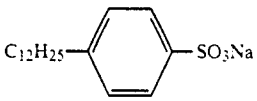
Surfactant (4)*
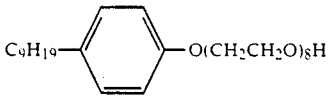
Film Hardening Agent (1)*
1,2-Bis(vinylsulfonylacetamido)ethane
High Boiling Point Organic Solvent (1)*
Tricyclohexyl phosphate
Anti-fogging Agent (1)*
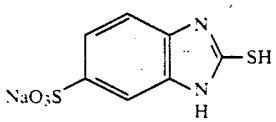
Anti-fogging Agent (1)*
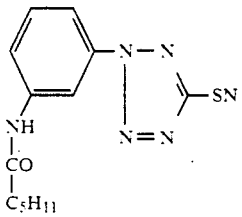
Electron Donor (ED-11)
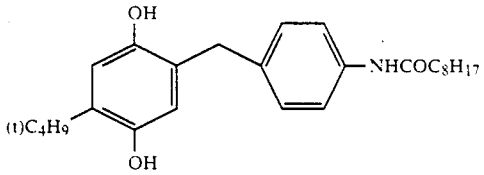
Reducing Agent (ED-37)
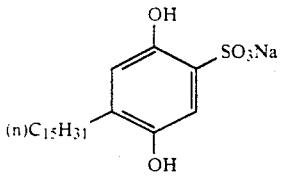
Electron Transfer Agent (X-22)

TABLE 2-continued
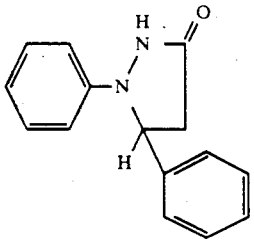
Sensitizing Dye (1)
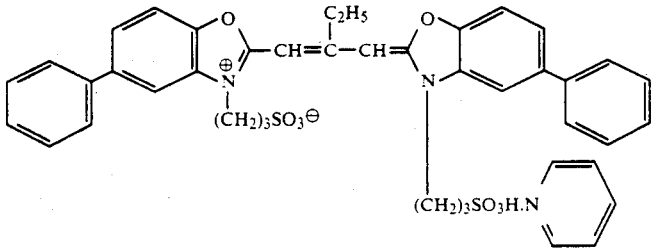
Sensitizing Dye (2)
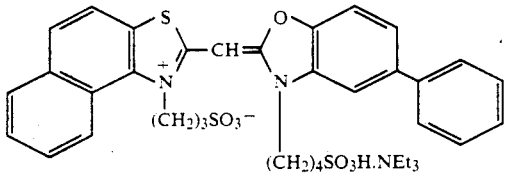
Et = $C_2H_5$
Sensitizing Dye (3)
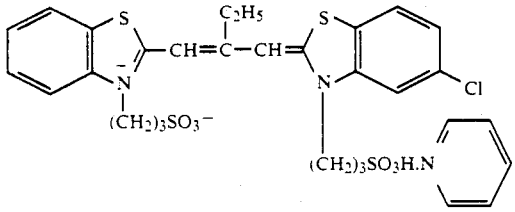
Sensitizing Dye (4)
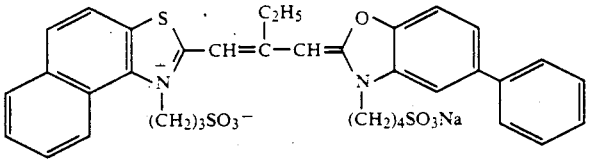
Yellow Dye Providing Substance (1)
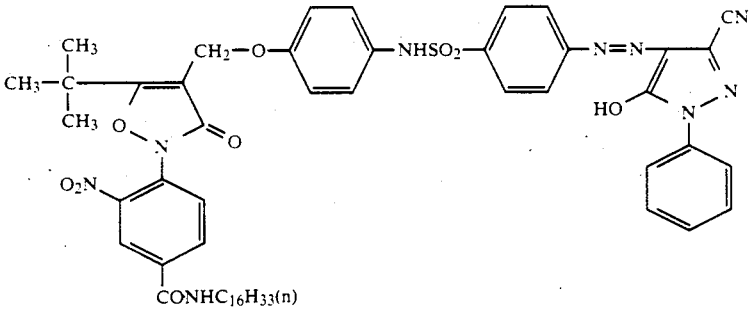
Magenta Dye Providing Substance (2)

TABLE 2-continued

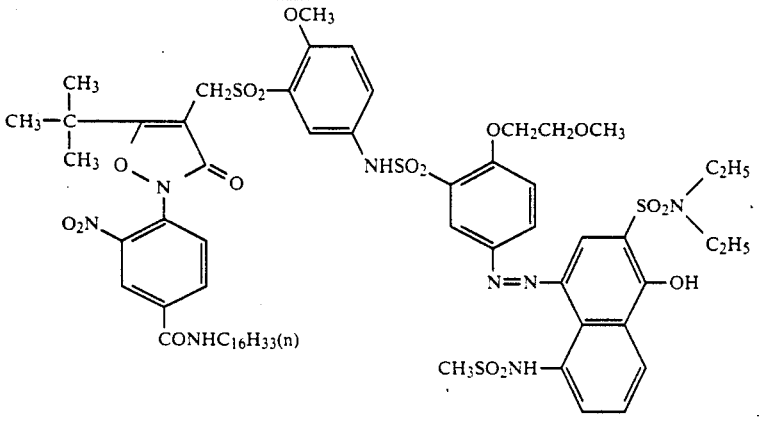

Cyan Dye Providing Substance (3)

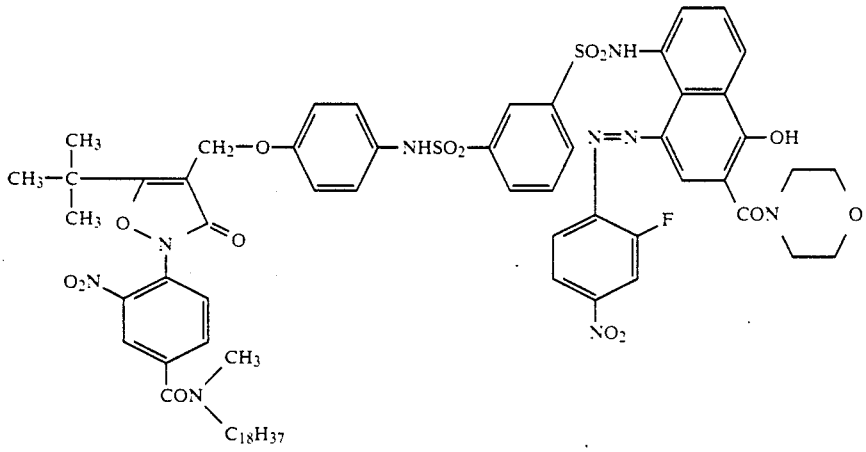

The preparation of the emulsion (I) used in the first layer is described below.

An aqueous solution (600 ml) containing sodium chloride and potassium bromide and an aqueous solution of silver nitrate obtained by dissolving 0.59 mol of silver nitrate (in 600 ml of water) were added simultaneously at equal flow rates over a period of 40 minutes to an aqueous gelatin solution (containing 20 grams of gelatin and 3 grams of sodium chloride in 1000 ml of water, maintained at a temperature of 75° C.) which was being thoroughly agitated. Furthermore, 200 ml of a methanol solution of 40 mg of the sensitizing dye (3) and 120 ml of the dye (4) were added over a period of 15 minutes from 30 minutes after the start of the addition of the aqueous silver nitrate solution. A monodisperse cubic silver chlorobromide emulsion (bromine content: 80 mol %) of average grain size 0.35 μm was obtained.

After washing with water and removing the salts, 5 mg of sodium thiosulfate and 20 mg of 4-hydroxy-6-methyl-1,3,3a,7-tetraazaindene were added and chemical sensitization was carried out at 60° C. The recovery of emulsion was 600 grams.

The preparation of emulsion (II) used in the third layer is described below.

An aqueous solution (600 ml) containing sodium chloride and potassium bromide and an aqueous solution of silver nitrate (obtained by dissolving 0.59 mol of silver nitrate in 600 ml of water) were added simultaneously at equal flow rates over a period of 40 minutes to an aqueous gelatin solution (containing 20 grams of gelatin and 4 grams of sodium chloride in 1000 ml of water, maintained at a temperature of 75° C.) which was being thoroughly agitated, and the dye solution (I), a solution, obtained by dissolving 160 mg of the sensitizing dye (D-22) in 400 ml of methanol, was added over a period of 2 minutes after the addition had been completed. A monodisperse cubic silver chlorobromide emulsion (bromine content 50 mol %) of average grain size 0.45 μm on which the dye was adsorbed was obtained.

After washing with water and removing the salts, 5 mg of sodium thiosulfate and 20 mg of 4-hydroxy-6-methyl-1,3,3a,7-tetraazaindene were added and chemical sensitization was carried out at 60° C. The recovery of emulsion was 600 grams.

The preparation of emulsion (III) used in the fifth layer is described below.

An aqueous solution (1000 ml) containing sodium iodide and potassium bromide and an aqueous solution of silver nitrate (obtained by dissolving 1 mol of silver nitrate in 1000 ml of water) were added simultaneously while maintaining a constant pAg value to an aqueous gelatin solution (20 grams of gelatin and ammonia dissolved in 1000 ml of water, maintained at a temperature of 50° C.) which was being thoroughly agitated. A monodisperse octahedral silver iodobromide emulsion (iodine content 2 mol %) was obtained.

After washing with water and removing the salts, 5 mg of chloroauric acid (tetrahydrate) and 2 mg of sodium thiosulfate were added and chemical sensitization with gold and sulfur was carried out at 60° C. The recovery of emulsion was 1 kg.

The preparation of the gelatin dispersion of the dye providing substances is described below.

Thirteen grams of the yellow dye providing substance (1), 6.5 grams of the high boiling point organic solvent (1) and 6.5 grams of the electron donor (ED-11) were added to and dissolved in 37 ml of cyclohexanone and this was mixed with stirring with 100 grams of a 10% gelatin solution and 60 ml of a 2.5% aqueous solution of sodium dodecylbenzenesulfonate. The mixture was then dispersed in a homogenizer at 1000 rpm for a period of 10 minutes. The dispersion obtained is referred to as the dispersion of the yellow dye providing substance.

The magenta dye providing substance (2) (16.8 grams), 8.4 grams of the high boiling point organic solvent (1) and 6.3 grams of the electron donor (ED-11) were added to and dissolved in 37 ml of cyclohexanone and this was mixed with stirring with 100 grams of a 10% gelatin solution and 60 ml of a 2.5% aqueous solution of sodium dodecylbenzenesulfonate, after which the mixture was dispersed in a homogenizer at 1000 rpm for a period of 10 minutes. The dispersion obtained is referred to as the dispersion of the magenta dye providing substance.

The cyan dye providing substance (3) (15.4 grams), 7.7 grams of the high boiling point organic solvent (1) and 6.0 grams of the electron donor (ED-11) were added to and dissolved in 37 ml of cyclohexanone and this was mixed with stirring with 100 grams of a 10% gelatin solution and 60 ml of a 2.5% aqueous solution of sodium dodecylbenzenesulfonate, after which the mixture was dispersed in a homogenizer at 1000 rpm for a period of 10 minutes. The dispersion obtained is referred to as the dispersion of the cyan dye providing substance.

The multi-layer color photosensitive materials described above were exposed for one tenth of a second using a tungsten lamp through B, G, R and gray color separating filters which varied the density continuously.

The exposed photosensitive materials were fed at a line rate of 20 mm/sec, water was supplied with a wire bar at the rate of 15 ml/m$^2$ to the emulsion surface and then the materials were immediately superimposed so that the film surface made contact with an image receiving material.

The samples were then heated for 20 seconds using a heater roller of which the temperature was adjusted in such a way that the wet film temperature was 85° C. On peeling away from the image receiving material, blue, green, red and gray images corresponding to the B, G, R and gray color separation filters were obtained on the image receiving materials (R-1) to (R-7).

A transparent film which had an ultraviolet absorbing layer was superimposed on the film surface of these image receiving materials on which the images had been formed and the images were illuminated for 3 weeks with the light from a fluorescent lamp (10,000 lux). The colored image densities were measured before and after exposure to the fluorescent lamp and the light fastness of the colored images was evaluated in this way.

The maximum densities (reflection densities) and the dye survival rates at a reflection density of 1.0 were measured and the results obtained are shown in Table 3.

TABLE 3

| Expt. No. | Colored Image | Image Receiving Material | Compound | Maximum Density | Dye Survival Rate (%) |
|---|---|---|---|---|---|
| 1 | Yellow | R-1 | None Added | 2.12 | 78 |
| 2 | " | 2 | II'-3 | 2.11 | 92 |
| 3 | " | 3 | II'-7 | 2.13 | 88 |
| 4 | " | 4 | II'-20 | 2.15 | 90 |
| 5 | " | 5 | V-2 | 2.12 | 93 |
| 6 | " | 6 | 2-2 | 2.11 | 98 |
| 7 | " | 7 | III-6 | 2.09 | 93 |
| 1 | Magenta | R-1 | None Added | 2.30 | 73 |
| 2 | " | 2 | II'-3 | 2.28 | 90 |
| 3 | " | 3 | II'-7 | 2.32 | 85 |
| 4 | " | 4 | II'-20 | 2.34 | 89 |
| 5 | " | 5 | V-2 | 2.33 | 90 |
| 6 | " | 6 | 2-2 | 2.29 | 91 |
| 7 | " | 7 | III-6 | 2.34 | 92 |
| 1 | Cyan | R-1 | None Added | 2.20 | 71 |
| 2 | " | 2 | II'-3 | 2.23 | 89 |
| 3 | " | 3 | II'-7 | 2.21 | 83 |
| 4 | " | 4 | II'-20 | 2.20 | 84 |
| 5 | " | 5 | V-2 | 2.19 | 88 |
| 6 | " | 6 | 2-2 | 2.28 | 87 |
| 7 | " | 7 | III-6 | 2.24 | 89 |

$$\text{Dye Survival Rate} = \frac{\text{Dye Density After Fluorescent Lamp Irradiation}}{\text{Dye Density Before Irradiation with Light}} \cdot 100$$

It is clear from the above results that the compounds of this invention are effective.

EXAMPLE 2

The image receiving material R-8 was prepared by coating with the structure shown in Table 4.

TABLE 4

Structure of the Image Receiving Material R-5

| Layer Number | Materials Added | | Amount (g/m$^2$) |
|---|---|---|---|
| Third Layer | Gelatin | | 0.05 |
| | Silicone oil (1)* | | 0.04 |
| | Surfactant (1)* | | 0.001 |
| | Surfactant (2)* | | 0.02 |
| | Surfactant (3)* | | 0.10 |
| | Matting agent (1)* | | 0.02 |
| | Anti-stick agent (1)* | | 0.03 |
| | Guanidine picolinate | | 0.45 |
| | Water soluble polymer (1)* | | 0.24 |
| | UV absorbers (1)*-(3)* | each | 0.03 |
| Second Layer | Mordant (1)* | | 2.35 |
| | Water soluble polymer (1)* | | 0.21 |
| | Gelatin | | 1.40 |
| | Water soluble polymer (2)* | | 0.60 |
| | High boiling point organic solvent (1)* | | 1.40 |
| | Antioxidant (1)* | | 1.00 |
| | Compound (II'-21)* | | 0.40 |
| | UV Absorbers (1)*-(3)* | each | 0.1 |
| | Fluorescent brightener (1)* | | 0.05 |
| | Guanidine picolinate | | 1.80 |
| | Surfactant (4)* | | 0.02 |
| First Layer | Gelatin | | 0.45 |
| | Surfactant (3)* | | 0.01 |
| | Water soluble polymer (1)* | | 0.04 |
| | Film hardening agent (2)* | | 0.30 |
| | Support (1)* | | |
| First Backing Layer | Gelatin | | 3.25 |
| | Film hardening agent (1)* | | 0.25 |
| Second Backing Layer | Gelatin | | 0.44 |
| | Silicone oil (1)* | | 0.08 |
| | Surfactant (4)* | | 0.05 |
| | Matting agent (2)* | | 0.09 |
| | Surfactant (5)* | | 0.01 |

Anti-stick Agent (1)*

TABLE 4-continued

Tetrafluoroethylene resin ("Teflon ® 30-J" made by Du Pont-Mitsui Fluorochemicals Company, Ltd.)

Ultraviolet Absorbers (1)*

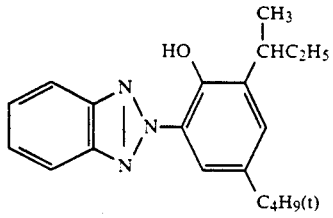

(2)*

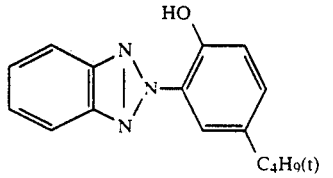

(3)*

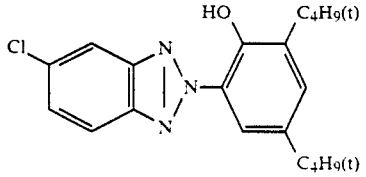

Water Soluble Polymer (3)*
Poly(sodium methacrylate)

Antioxidant (1)*

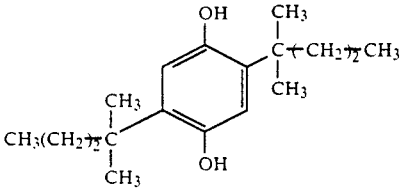

Fluorescent Brightener (1)*

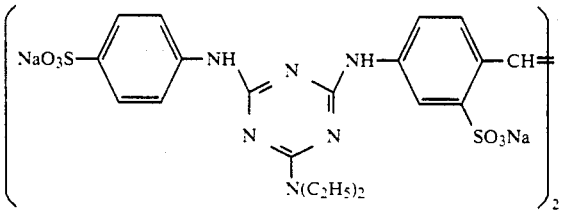

The other compounds used were the same as those used in Example 1.

An image receiving material R-9 was then prepared in exactly the same way except that compound II'-21 in the image receiving material R-8 was replaced by compound A below of which $k_q \cdot T_1$ had a value of $1\times10^4$ $M^{-1}\cdot sec^{-1}$.

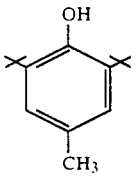

A

Blue, green, red and gray images corresponding to the color separation filters were then obtained on the image receiving materials R-8 and R-9 by using these image receiving materials with thermal development and transfer by following the same procedure as in Example 1, using the photosensitive material (K-1).

The maximum densities (reflection densities) and the dye survival rates at a reflection density of 1.0 were measured in the same way as in Example 1 and the results obtained were as shown in Table 5.

TABLE 5

| Number | Colored Image | Image Receiving Material | Compound | Maximum Density | Dye Survival Rate |
|---|---|---|---|---|---|
| 8 | Yellow | R-8 | II'-21 | 2.13 | 90 |
| 9 | " | R-9 | A | 2.11 | 77 |
| 8 | Magenta | R-8 | II'-21 | 2.32 | 89 |
| 9 | " | R-9 | A | 2.29 | 77 |
| 8 | Cyan | R-8 | II'-21 | 2.23 | 88 |
| 9 | " | R-9 | A | 2.25 | 73 |

EXAMPLE 3

Photosensitive material K-2 was prepared in exactly the same way as described in Example 1 of JP-A-62-253159, and exposure and development processing was carried out in exactly the same way as described in Example 1 of JP-A-62-253159 except that the image receiving materials R-1 to R-9 of Examples 1 and 2 of this invention were used as image receiving materials.

Image receiving materials R-2 to R-8 which contained compounds of this invention exhibited excellent fastness of the colored image when the yellow, magenta and cyan images so obtained were left to stand for 3 weeks under irradiation with the same fluorescent lamp as in Example 1 of the present invention.

While the invention has been described in detail and with reference to specific embodiments thereof, it will be apparent to one skilled in the art that various changes and modifications can be made therein without departing from the spirit and scope thereof.

What is claimed is:

1. A method for stabilizing a dye image in a dye fixing element, comprising the steps of exposing imagewise a heat developable color photosensitive element which has a construction which includes, on a support, at least a phototsensitive silver halide, a binder and a dye providing substance which forms or releases a diffusible azo dye in proportion, or in inverse proportion, to a reaction in which the silver halide is reduced to silver; thereafter or simultaneously heating said photosensitive element to form a diffusible azo dye; and transferring the diffusible azo dye to a dye fixing element to form a dye image, wherein the dye fixing element comprises at least one compound for which the quenching rate constant for the excited triplet of arylazonaphthol dyes is at least $1\times10^5$ $M^{-1}\cdot sec^{-1}$ and/or the quenching rate constant for singlet state oxygen is at least $1\times10^7$ $M^{-1}\cdot sec^{-1}$, wherein said compound is an anti-color fading agent represented by general formula (II') or (IV):

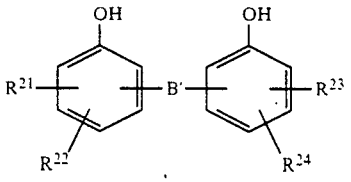

(II')

wherein $B^1$ represents —S—, —S—S—, —O—, —$CH_2$—S—$CH_2$—, —$SO_2$—, —SO—, —$CH_2$—O—$CH_2$—,

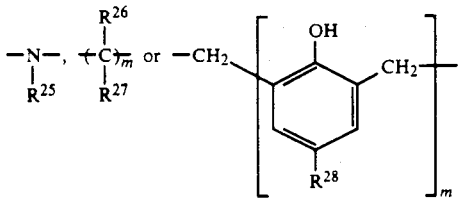

$R^{21}$, $R^{22}$, $R^{23}$ and $R^{24}$ each independently represents a hydrogen atom; an alkyl group which has from 1 to 20 carbon atoms; an aryl group; an aralkyl group; an alkylthio group; a halogen atom; an alkoxy group; an arylthio group; an aralkoxy group; an aryloxy group; —$COOR^{29}$; —$NHCOR^{29}$; —$NHSO_2R^{29}$; —$SO_2R^{29}$; —O—$COR^{29}$;

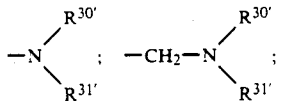

or —$(CH_2)_n$—A'; $R^{25}$ represents a hydrogen atom, an alkyl group or an aryl group; $R^{26}$ and $R^{27}$ each independently represents a hydrogen atom, an alkyl group or an aryl group, or they may be joined together to form a five or six membered ring; $R^{28}$ represents a hydrogen atom or a methyl group; $R^{29}$ represents an alkyl group or an aryl group; and $R^{30'}$ and $R^{31'}$ each independently represents a hydrogen atom, an alkyl group; an aryl group, a heterocyclic group or an aralkyl group, or they may be joined together to form a five or six membered heterocyclic ring which may be substituted; A' represents an ester group or

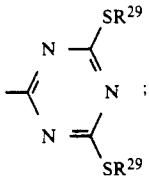

and m and n represent integers of from 1 to 3;

(IV)

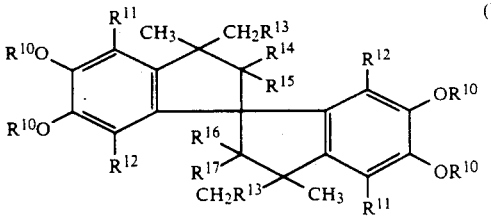

wherein $R^{10}$ represents an alkyl group, an alkenyl group, an aryl group, an aralkyl group, a heterocyclic group or a group represented by $R^{18}CO$, $R^{19}SO_2$ or $R^{20}NHCO$, wherein $R^{18}$, $R^{19}$ and $R^{20}$ each independently represents an alkyl group, an alkenyl group, an aryl group or a heterocyclic group; $R^{11}$ and $R^{12}$ each independently represents a hydrogen atom, a halogen atom, an alkyl group, an alkenyl group, an alkoxy group or an alkenoxy group; and $R^{13}$, $R^{14}$, $R^{15}$, $R^{16}$ and $R^{17}$ each independently represents a hydrogen atom, an alkyl group, an alkenyl group or an aryl group.

2. A method as recited in claim 1, wherein the amount of said anti-fading agent contained in said dye fixing element is an amount of from 0.01 to 1 mol per mol or said dye providing substance in said photosensitive element.

* * * * *